US012789043B2

(12) United States Patent
Galka et al.

(10) Patent No.: US 12,789,043 B2
(45) Date of Patent: Nov. 10, 2026

(54) SYSTEMS AND METHODS FOR AN ARTIFICIAL INTELLIGENCE (AI)-BASED MONITORING OF A FORMATION OF RACERS

(71) Applicants: Constructor Technology AG, Schaffhausen (CH); Constructor Education and Research Genossenschaft, Schaffhausen (CH)

(72) Inventors: Ruslan Galka, Sofia (BG); Serg Bell, Singapore (SG); Stanislav Protasov, Singapore (SG); Nikolay Dobrovolskiy, Alanya (TR); Laurent Dedenis, Geneva (CH)

(73) Assignee: Constructor Technology AG, Schaffhausen (CH)

( * ) Notice: Subject to any disclaimer, the term of this patent is extended or adjusted under 35 U.S.C. 154(b) by 131 days.

(21) Appl. No.: 18/986,853

(22) Filed: Dec. 19, 2024

(65) Prior Publication Data

US 2026/0175081 A1 Jun. 25, 2026

(51) Int. Cl.
*A63B 24/00* (2006.01)

(52) U.S. Cl.
CPC ..... *A63B 24/0021* (2013.01); *A63B 24/0084* (2013.01); *A63B 2024/0025* (2013.01); *A63B 2220/14* (2013.01)

(58) Field of Classification Search
CPC ..... A63B 24/0021; A63B 24/0084; A63B 2024/0025; A63B 2220/14; G06N 5/00; G06N 5/022; G06N 3/042; G06N 3/044; G06N 3/045; G06F 16/75; G06F 16/783
See application file for complete search history.

(56) References Cited

U.S. PATENT DOCUMENTS

| | | | | |
|---|---|---|---|---|
| 2011/0032361 | A1* | 2/2011 | Tamir | H04N 7/181 348/157 |
| 2025/0315695 | A1* | 10/2025 | Horton | G06F 16/75 |
| 2025/0316082 | A1* | 10/2025 | Lucey | G06V 20/42 |

FOREIGN PATENT DOCUMENTS

| | | | | |
|---|---|---|---|---|
| CA | 3183228 | A1 * | 12/2021 | G06N 3/0464 |
| CN | 114728199 | A * | 7/2022 | A63F 13/90 |
| WO | WO-2023170749 | A1 * | 9/2023 | G06Q 50/34 |
| WO | WO-2024145648 | A1 * | 7/2024 | G06N 5/022 |
| WO | WO-2024145649 | A1 * | 7/2024 | G06N 3/09 |

* cited by examiner

*Primary Examiner* — Steven J Hylinski
(74) *Attorney, Agent, or Firm* — ArentFox Schiff LLP; Michael Fainberg

(57) ABSTRACT

Disclosed herein are systems and method for an artificial intelligence (AI)-based monitoring of a formation of racers. In one aspect, a method includes: obtaining geolocation data for a group of racers on a race course and a digital map of the race course configured to track movement of the group of racers in a formation; determining a type of race and a type of race course, and at least one assigned formation for the group of racers corresponding to the type of race and the race course along a plurality of locations; analyzing the digital map of the race course and the geolocation data of racers at the plurality of locations using a trained formation neural network trained to analyze group formations for different types of races and different types of race courses; and displaying a formation statistics for the at least one racer based on the analysis.

20 Claims, 10 Drawing Sheets

SYSTEMS AND METHODS FOR AN ARTIFICIAL INTELLIGENCE (AI)-BASED MONITORING OF A FORMATION OF RACERS

FIELD OF TECHNOLOGY

The present disclosure relates to the field of machine learning, and, more specifically, to systems and methods for an artificial intelligence (AI)-based monitoring of a formation of racers.

BACKGROUND

Reviewing post-race data analytics has become a cornerstone in the world of competitive racing due to its ability to provide invaluable insights that extend far beyond a finishing time of a competitive athlete or racer. Post-race analysis leverages sophisticated data collection and analytics tools to dissect every aspect of a racer's performance. By examining a racer's telemetry race data such as speed, power, heartrate, elevation, geolocation, or the like, coaches and racers may pinpoint strengths, identify areas for improvement, and strategize for future competitions. This comprehensive approach not only enhances individual performance, but also contributes to the advancement of training methodologies and injury prevention techniques. In this way, post-race data analysis transforms raw telemetry data into actionable data.

However, despite the increase in availability of telemetry data, there are still many difficulties in analyzing and synchronizing the telemetry data. For example, it may be difficult to match telemetry data for a racer with video of the racer due to the video feed of races not being geotagged. As another example, traditionally, telemetry data is obtained and stored in excel spreadsheets such that it is difficult to match up telemetry data with certain portions of the race. Accordingly, support teams and analysts for the racers must manually capture screenshots from videos, identify and track racers from the screenshots throughout a duration of the race and then match the telemetry data from spreadsheets to pictures in a power point slide in order to analyze and present post-race analysis. By utilizing neural networks, analysts may more easily synchronize telemetry data of their racers with race videos and map data in order to generate post-race data analysis and presentations.

SUMMARY

To address the shortcomings of preparing and reviewing conventional post-race analysis, the present disclosure describes training neural networks to analyze group formations for different types of races and different types of race courses. Some of the technical improvements of the present disclosure include calculating the direction of movement for racers using General Packet Radio Service (GPRS) and/or telemetry data to create a movement map. Another technical improvement is to analyze positions of each racer during a race relative to others and provide statistics on positions and time spent in position during a race. Yet another technical improvement of the present disclosure is the provision of a dynamic and interactive user interface that effectively combines and displays formation statistics for a racer based on the analysis and allows support teams and analysts to focus on data analysis and strategy of their individual racers rather than spend time manually identifying and tracking racers during a duration of a race and syncing up the different types of data post-race.

In one exemplary aspect, a method for an artificial intelligence (AI)-based monitoring of a formation of racers is disclosed, the method comprising: obtaining geolocation data for a group of racers on a race course and a digital map of the race course configured to track movement of the group of racers in a formation along a plurality of locations of the race course; determining a type of race and a type of race course, and at least one assigned formation for the group of racers corresponding to the type of race and the race course along a plurality of locations of the race course; analyzing the digital map of the race course and the geolocation data of racers at the plurality of locations of the race course using a trained formation neural network trained to analyze group formations for different types of races and different types of race courses, wherein the trained formation neural network is configured to: predict an assigned position of each racer in the formation at a plurality of locations of the race course; detect a deviation from the assigned position of each racer in the formation; determine a reason for the detected deviations, and calculate an impact of the deviations on a race performance of the group; and displaying, on a UI, a formation statistics for the at least one racer based on the analysis, wherein the formation statistics comprises at least one of: (i) any deviations by at least one racer from the assigned position within the formation, (ii) a reason for the deviation, and (ii) an impact of the deviation on the race performance of the group.

In one aspect, determining the at least one assigned formation of the group of racers further comprises: calculating a movement direction for each racer from a first location on the race course to a second location on the race course using the geolocation data; and determining a position for at least one racer from the group of racers relative to positions of other racers belonging to the same formation.

In one aspect, the formation neural network is further configured to generate recommendations for improving the race performance of the group in different race conditions based on the detected deviations and the determined reasons for the deviations.

In one aspect, the formation statistics further comprise at least one of: (i) a distance between other racers in the formation, (ii) overlapping coordinates of racers belonging to the same formation, (ii) changes in the distance between other racers in the formation, or (iv) a number of team connections.

In one aspect, the trained formation neural network is trained to predict the assigned position of each racer in the formation at a plurality of locations of the race course based on analyzing historical data of videos of formations of racers from previous races on the same race course.

In one aspect, the trained formation neural network is trained to predict the assigned position of each racer in the formation at a plurality of locations of the race course based on analyzing historical data of videos of formations of racers from previous races on the difference race courses.

In one aspect, predicting the assigned position of each racer in the formation at the plurality of locations of the race course further comprises: inputting racer-specific features for each racer into the trained formation neural network to predict a future position of each racer at the plurality of locations on the race track, wherein the racer-specific features correspond to at least one of: a current position, a current velocity, a current acceleration, a skill level, speed, historical positions, velocities at previous locations on the race track, or accelerations at previous locations on the race track, wherein the trained formation neural network data is trained to predict the future position of each racer based on a training dataset for each racer comprising at least lap times, previous racer positions at different locations of the race course, and velocities at different locations of the race course, and obtaining an output of a relative position of each racer at future time steps or a at each location of the race course on the digital map based on the result of the trained formation neural network.

In one aspect, detecting the deviation from the assigned position of each racer in the formation further comprises: inputting racer-specific features, race course features, and interactions for each racer into the trained formation neural network to learn a normal pattern of positions of the racers in the formation and to identify deviations from the assigned position of the racer, wherein the racer-specific features correspond to at least one of: a current position, a past position, a current velocity, a past velocity, a current acceleration, a past velocity, assigned position, actual position, physical characteristics of the racer, or behavioral characteristics of the racer, wherein the race course features correspond to at least a location on a track, track conditions, track segments, or environmental factors, wherein the interactions correspond to relative positions of other racers in the formation, history of events, or racing strategy, and obtaining an output of a deviation score for each racer at each time step or at each location of the race course on the digital map based on the result of the trained formation neural network.

In one aspect, determining a reason for the detected deviations further comprises: obtaining a label and a deviation feature for each racer at each time step or at each location of the race course on the digital map based on the result of the trained formation neural network, wherein the label may correspond to at least one of: speed adjustment, avoiding collision, tire wear, mechanical failure, track condition effect, weather impact, pit stop strategy, or overtake attempt, wherein the deviation feature corresponds to at least one of magnitude and frequency of deviations from the assigned position for each racer, or a duration spent deviating from the assigned position.

In one aspect, calculating the impact of the deviations on the race performance of the group further comprises: using a regression task to predict a metric that quantifies an overall race performance for the group of racers based on the deviation feature of each racer from the assigned positions, wherein the metric comprises at least one of: (i) total race time, (ii) average speed, or (iii) success rate.

In one aspect, the method further comprises executing a trained geolocation neural network to generate additional telemetry data to supplement the obtained geolocation data using a geolocation neural network model based at least in part on analyzing the obtained geolocation data, wherein the trained telemetry neural network is trained to supplement geolocation data using a training set comprising of geolocation data for racers and based on analyzing historical geolocation data of each racer.

In one aspect, the method further comprises displaying, on the UI, a digital map of the race course and a visual position identifier generated to identify and track a position of each racer in the formation along the race course on the digital map based on at least the geolocation data.

In one aspect, the method further comprises: obtaining at least one racing video of competitor racers on the race course; identifying unique geolocations of the race course in the racing videos and on the digital map of the race course; executing a trained racer identification neural network to visually identify and track at least one competitor racer corresponding to at least at an identified unique geolocations in the racing videos; synchronizing the racing video and the digital map for the identified at least one competitor to determine a position of the at least one competitor racer; analyzing the digital map of the race course, the geolocation data of racers at the plurality of locations of the race course, and the identified at least one competitor at the plurality of locations of the race course using a trained formation neural network; and provide, on a UI, the formation statistics for the at least one racer based on the analysis.

In one aspect, the method further comprises: executing the trained racer identification neural network to identify the at least one competitor racer in the at least one racing video based at least in part on identifying visual appearances of each racer, wherein the trained racer identification neural network is trained to distinguish between visual appearances of each racer using a training set comprising of images of racers and a racer label identifying each racer in the images.

According to one aspect of the disclosure, a system is provided an artificial intelligence (AI)-based monitoring of a formation of racers, the system comprising at least one memory; and at least one hardware processor coupled with the at least one memory and configured, individually or in combination to: obtain geolocation data for a group of racers on a race course and a digital map of the race course configured to track movement of the group of racers in a formation along a plurality of locations of the race course; determine a type of race and a type of race course, and at least one assigned formation for the group of racers corresponding to the type of race and the race course along a plurality of locations of the race course; analyze the digital map of the race course and the geolocation data of racers at the plurality of locations of the race course using a trained formation neural network trained to analyze group formations for different types of races and different types of race courses, wherein the trained formation neural network is configured to: predict an assigned position of each racer in the formation at a plurality of locations of the race course; detect a deviation from the assigned position of each racer in the formation; determine a reason for the detected deviations, and calculate an impact of the deviations on a race performance of the group; and displaying, on a UI, a formation statistics for the at least one racer based on the analysis, wherein the formation statistics comprises at least one of: (i) any deviations by at least one racer from the assigned position within the formation, (ii) a reason for the deviation, and (ii) an impact of the deviation on the race performance of the group.

In one exemplary aspect, a non-transitory computer-readable medium is provided storing a set of instructions thereon for an artificial intelligence (AI)-based monitoring of a formation of racers, wherein the set of instructions comprises instructions for: obtaining geolocation data for a group of racers on a race course and a digital map of the race course configured to track movement of the group of racers in a formation along a plurality of locations of the race course; determining a type of race and a type of race course, and at least one assigned formation for the group of racers corresponding to the type of race and the race course along a plurality of locations of the race course; analyzing the digital map of the race course and the geolocation data of racers at the plurality of locations of the race course using a trained formation neural network trained to analyze group formations for different types of races and different types of race courses, wherein the trained formation neural network is configured to: predict an assigned position of each racer in the formation at a plurality of locations of the race course; detect a deviation from the assigned position of each racer in the formation; determine a reason for the detected deviations, and calculate an impact of the deviations on a race performance of the group; and displaying, on a UI, a formation statistics for the at least one racer based on the analysis, wherein the formation statistics comprises at least one of: (i) any deviations by at least one racer from the assigned position within the formation, (ii) a reason for the deviation, and (ii) an impact of the deviation on the race performance of the group.

The above simplified summary of example aspects serves to provide a basic understanding of the present disclosure. This summary is not an extensive overview of all contemplated aspects, and is intended to neither identify key or critical elements of all aspects nor delineate the scope of any or all aspects of the present disclosure. Its sole purpose is to present one or more aspects in a simplified form as a prelude to the more detailed description of the disclosure that follows. To the accomplishment of the foregoing, the one or more aspects of the present disclosure include the features described and exemplarily pointed out in the claims.

BRIEF DESCRIPTION OF THE DRAWINGS

The accompanying drawings, which are incorporated into and constitute a part of this specification, illustrate one or more example aspects of the present disclosure and, together with the detailed description, serve to explain their principles and implementations.

Like reference numbers and designations in the various drawings indicate like elements.

DETAILED DESCRIPTION

Figure 1:
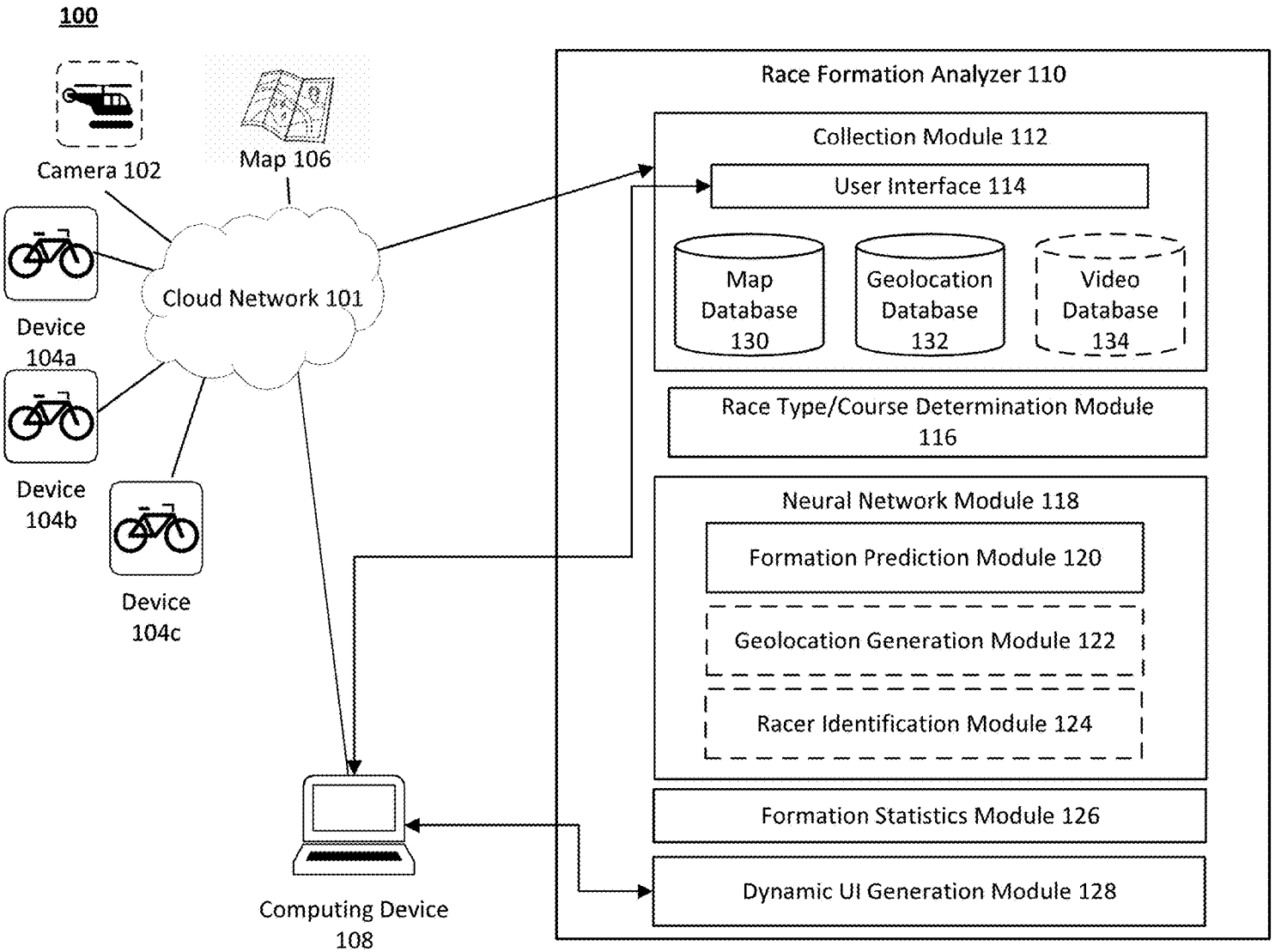
FIG. 1 is a block diagram illustrating a system for an artificial intelligence (AI)-based monitoring of a formation of racers according to aspects of the present disclosure.

Exemplary aspects are described herein in the context of a system, method, and computer program product for an artificial intelligence (AI)-based monitoring of a formation of racers. Those of ordinary skill in the art will realize that the following description is illustrative only and is not intended to be in any way limiting. Other aspects will readily suggest themselves to those skilled in the art having the benefit of this disclosure. Reference will now be made in detail to implementations of the example aspects as illustrated in the accompanying drawings. The same reference indicators will be used to the extent possible throughout the drawings and the following description to refer to the same or like items.

The present disclosure describes various aspects of synchronizing race telemetry, video, and map data in a dynamic user interface (UI) using neural networks. One aspect involves training a racer identification neural network to identify racers in a plurality of videos. Optionally, a second aspect involves training a geolocation identification neural network to identify unique geolocations of a race course in the plurality of videos and to identify corresponding unique geolocations on the map of the race course. A third aspect involves using a neural network to identify images where a racer is passing the unique geolocations in the racing videos in order to synchronize the plurality of videos, the map, and the telemetry data for each racer. A fourth aspect involves using a neural network to analyze group formations of racers for different types of races and different types of race courses.

First, consider that within a racing video, there may be hundreds of racers riding so closely together in crowds that it becomes difficult to identify individual racers in a single frame, much less track the individual racers throughout the duration of the race or across different video feeds. In addition, racers may closely resemble each other due to wearing similar colors, similar types of uniforms or helmets, or similar equipment. Furthermore, camera angles such as high helicopter views may not be able to properly show uniforms or assigned racing numbers of the racers at that particular camera angle such that it becomes difficult to identify racers when watching these race feeds. Furthermore, it may be tedious to track the same racers across different video feeds. Accordingly, image recognition using neural networks may be utilized to identify and learn visual appearances and/or physiological characteristics of particular racers and then use the trained neural networks to identify the racers within race videos.

Second, an anatomy of a race course may have different unique geolocations representing key locations along the race course. The different unique geolocations may include sections of the race course such as a starting line, pit stop, different types of turns, points of interest such as uphill, downhills, or different types of buildings such as a church, a farm, etc. Accordingly, image recognition using neural networks may also be utilized to identify and learn visual appearances of unique geolocations and then use the trained neural networks to identify the unique geolocations within the race videos or on a map. These unique geolocations may be used as "markers" along a race course or video to sync up race telemetry data as racers pass by these geolocations.

By synchronizing different video feeds, map data, and telemetry data for each racer, a dynamic UI may display a playback of a video with racers identified by a visual identifier such as different colored boxes that track the racers during the race and across the different video feeds, a digital map of the race course with visual identifiers tracking the position of the racers along a race course in accordance with the playback of the video, and race telemetry data associated with the racers at the point of playback of the video.

Accordingly, a user may select a different point of playback in the video and the visual identifiers tracking the positions of the racers along the race course along with the race telemetry data will update in accordance with playback of the video. Similarly, a user may also select different positions along the race course and the playback of the video and the race telemetry data of the racer will update according to the selected position of the racer along the race course. In this way, the dynamic and interactive UI may be easily controlled by the support teams or analysts to review different portions of the race course at different views and angles and automatically have each portion of the dynamic UI be updated accordingly. This is much more efficient and accurate than the conventional method of manually identifying and tracking racers in, transferring telemetry data from spreadsheets and manually matching the telemetry data matches to particular points of a race.

In addition, monitoring and analyzing the position of racers in formation allows teams and individuals to optimize performance, converse energy, reduce risks, and implement strategic decisions that can ultimately influence the outcome of the race. For example, in races like cycling or motorsports, the position of each racer in a formation can significantly impact aerodynamics. By riding or driving close together, racers can reduce air resistance, which converses energy or fuel. As an example, in cycling, drafting (e.g., riding closely behind another cyclist) can reduce drag and help the trailing cyclist use up to 30% less energy. As another example, formations allow teams to implement tactical strategies. For instance, in cycling, a team may create a "lead-out" train, where one cyclist pulls out at high speed to prepare a sprinter for a final burst of speed. As yet another example, in team-based racing, formations can be used to protect key riders or drivers. Teammates may surround the leader to shield them from wind, reduce risk of crashes, or help them maintain a position within the pack. Analyzing formations helps racers and teams understand the positioning and intentions of their competitors. It allows for anticipation of attacks, sprints, or strategic moves. Teams can track changes in formation to predict when an opponent is planning a move or conserving energy for a later stage.

Turning now to the figures, example aspects are depicted with reference to one or more components described herein, where components in dashed lines may be optional.

FIG. 1 is a block diagram illustrating a system 100 for an AI-based monitoring of a formation of racers. The system 100 may be used to calculate and display formation statistics for racers on a computing device 108 by obtaining geolocation data obtained from racers via respective sensors and devices 104*a*, 104*b*, 104*c* and a digital map 106 of the race course. The cloud network 101 or computing device 108 may communicate with a race formation analyzer 110 and a computing device 108.

The system 100 includes an optional camera 102 connected to a cloud network 101 or computing device 108. As an example, the cloud network 101 or computing device 108 may be a server that receives footage from different cameras. Each different camera may provide a different view or capture different portions of the race course. As a non-limiting example, the camera 102 may correspond to a camera from a helicopter providing a helicopter view (e.g., bird's eye view) of the racers along the race course, an optional camera (not pictured) may correspond to a camera operated by a team member along a particular portion of the race course, and an optional camera (not pictured) may correspond to a camera mounted to a support vehicle following the racers. Although only one camera 102 is shown in FIG. 1, one skilled in the art will appreciate that any number of cameras, any types of cameras, or any type of video feeds may be used or obtained. In some aspects, there may be one camera for each racer or each geolocation along a race course. In some aspects, a camera may be fixed in a particular location of the racing environment. In some aspects, a camera may be a body camera worn by a racer or mounted onto a racing vehicle, boat, or horse.

Geolocation data refers to the real-time collection and transmission of data from a racer via sensors or devices worn by a racer or the racer's equipment to a remote monitoring system during the race for pinpointing the physical locations of the device or person at a specific time. Geolocation data may be obtained through several different technologies, including Global Positioning System (GPS), cell tower triangulation, Wi-Fi networks, or Bluetooth Beacons. This type of real-time geolocation data allows the Race Formation Analyzer 110 to track racers in their formations during a race.

As shown in system 100, during a racing event, the sensors and devices 104*a*, 104*b*, 104*c* may capture different types of geolocation data associated with each individual racer or vehicle to track individual movement of the group of racers in a formation along a plurality of locations of the race course. The system may also include a plurality of sensors and devices capable of capturing race telemetry data from each individual racer. Specifically, system 100 includes a plurality of sensors and devices 104*a*, 104*b*, or 104*c* connected to the cloud network 101 or computing device 108. In some aspects, the cloud network 101 or computing device 108 may be a server that obtains geolocation data from each individual racer. Each different sensor and device 104*a*, 104*b*, 104*c* may collect a different geolocation data from a respective racer on a team.

Although only three sensors and devices 104*a*, 104*b*, 104*c* for three racers are shown in FIG. 1, one skilled in the art will appreciate that any number of sensors or devices for any number of racers may be used.

The cloud network 101 or computing device 108 may also communicate with different digital mapping services or databases to obtain a digital map 106 of the race course. The map 106 of the race course will allow the dynamic UI display to show an exact position of each racer on the map at a particular point of playback of the race during post-race analysis. In addition, the map of the race course may be interactive and allow users to select a particular location on the map in order to identify which racers are at the selected location, check race telemetry data for the identified racers at the selected locations, and view video footage from multiple cameras from the selected location.

The system 100 may also include a computing device 108 and a race formation analyzer 110. The computing device 108 allows for a user to control and configure the system 100 and also view a dynamic UI. Computing device 108 may execute a plurality of modules in the race formation analyzer 110 that together make up an identification, analysis, and calculation system. In some aspects, the race formation analyzer 110 may correspond to a computing device 108 or cloud network 101 that is configured to execute a plurality of modules that together make up the race formation analyzer 110. The race formation analyzer 110 may obtain geolocation data from each racer among a group of racers on a race course and a digital map 106 of the race course configured to track movement of the group of racers in a formation along a plurality of locations of the race course for support team members and analysts to review post-race.

In some aspects, the race formation analyzer 110 may include a collection module 112, a user interface (UI) 114, a race type/course determination module 116, a neural network module 118 including a formation prediction module 120, an optional geolocation generation module 122, and an optional racer identification module 124, a formation statistics module 126, and a dynamic UI generation module 128, a map database 130, a geolocation database 132, and an optional video database 134.

The computing device 108 may execute a collection module 112 that collects and obtains data from the cloud network 101 such as video feeds from the camera 102, geolocation data from devices 104*a*, 104*b*, 104*c* of each racer, and/or the digital map 106. The collection module 112 may be configured to collect and store the map data in a map database 130, store video feeds from the camera 102 in the optional video database 134, and geolocation data from devices 104*a*, 104*b*, 104*c* in a geolocation database 132. In some aspects, a user may control the amount and different type of data to obtain from the cloud network 101 using a UI 114.

The computing device 108 may execute a race type/course determination module 116 that is configured to determine a type of race and a type of race course based on analyzing the digital map. In this way, the race type/course determination module 116 may determine an assigned formation for the group of racers based on the determined type of race and type of race course. For example, if the type of race is determined to be a "sprint race" then a tight formation may be assigned to maximize speed and minimize air resistance. As another example, if the race type is determined to be an "endurance race" then, the formation may be more spread out to manage pace and conserve energy.

As a first example, if the type of race course is a "flat course," then a linear or echelon formation may be assigned to take advantage of "drafting." As a second example, if the type of race course is a "Hilly or Mountainous course," then the formation may be more flexible to allow for individual pacing on climbs. As a third example, if the type of race is a "technical course," (e.g., course with may turns), then the formation may be staggered or single-file formation to navigate turns safely. Accordingly, different formations are essential to optimize performance, ensure safety, and execute strategic plans effectively. This also allows racers to adapt to the specific demands of the race type, course characteristics, and environmental conditions, ultimately influencing the outcome of the race.

The computing device 108 may also execute a neural network module 118 including a formation prediction module 120, an optional geolocation generation module 122, and an optional racer identification module 124 which both contain specific trained neural networks. A neural network is a type of machine learning process that uses interconnected nodes or neurons in a layered structure that resembles the human brain. The neural networks create an adaptive system that computers use to learn from their mistakes and improve continuously by comprehending unstructured data and make observations without explicit training. With neural networks, computers may distinguish and recognize images similar to humans. However, both the neural networks in the racer identification module 118 and the geolocation identification module 120 must first go through training to teach the neural networks to perform their respective specific tasks.

The neural network module 118 may comprise one or more neural networks, which are a class of machine learning models inspired by the structure and functioning of the human brain. They consist of interconnected nodes, called neurons or artificial neurons, organized into layers. Neural networks are capable of learning complex patterns and representations from data. The neural network executed by neural network module 118 may be one of the following: transformer neural network, convolution neural network (CNN), recurrent neural network (RNN), long short-term memory (LSTM) network, gated recurrent unit (GRU) network, autoencoder, generative adversarial network (GAN).

A transformer is a deep learning architecture used in large language models (LLMs). The transformer has an encoder/decoder structure with numerous stacked multi-head attention layers and feed forward network layers. This architecture allows the model to process and generate text effectively, capturing long-range dependencies and contextual information. Transformer are well-suited for tasks like natural language processing, and image classification and generation. Common examples of transformer models are generative pre-trained transformer (GPT) and Bidirectional Encoder Representations from Transformers (BERT).

A CNN is specialized for processing grid-like data, such as images, and employs convolutional layers to learn spatial hierarchies of features, reducing the need for manual feature engineering. CNNs are well-suited for tasks like image classification, object detection, and image generation.

An autoencoder is a type of neural network used for unsupervised learning and dimensionality reduction, and consists of an encoder that compresses input data into a lower-dimensional representation (encoding) and a decoder that reconstructs the original input from the encoding.

A GAN comprises a generator and a discriminator trained simultaneously through adversarial training. The generator aims to generate realistic data, while the discriminator tries to distinguish between real and generated data. A GAN is widely used for image and content generation tasks.

For prediction tasks such as formation prediction, an untrained neural network in the formation prediction module 120 will first analyze historical data of videos of formations of racers from previous races on the same race course to predict an assigned position of each racer in the formation at a plurality of locations of the race course. In some aspects, the untrained neural network in the formation prediction module 120 will first analyze historical data of videos of formations of racers from previous races on the different race courses. As an example, the training dataset may include labeled training data consisting of historical data of videos of formations of racers and their corresponding ground truth labels (e.g., type of formation or position in formation). Accordingly, since the formation prediction module 120 is designed to classify objects from different classes (e.g., different formations), then the training data will need samples from every single racer that is to be identified. Typically, thousands of samples from each class may be required.

During training of the neural network in the formation prediction module 120 to predict the assigned position of each racer in the formation, the training dataset comprises training dataset for each racer comprising at least lap times, previous racer positions at different locations of the race course, and velocities at different locations of the race course that are input through an untrained neural network in the formation prediction module 120. The results from the untrained neural network are then compared with known data set results using the corresponding labels identifying assigned position in the images. It should be noted that the input to the formation prediction module 120 will only be the data from the training dataset.

For every input training sample from the training dataset, the neural network from the formation prediction module 120 will produce a prediction consisting of values representing the probability that the input image corresponds to a given class (e.g., a given position). The output with the highest probability determines the predicted position label. A class label for each input image is used to compute a loss (e.g., loss function).

The formation prediction module 120 then uses a loss function that quantifies the error between the predicted output and the ground truth (e.g., position label) for a given training sample. In other words, the loss function can be used to guide the learning process by updating the network weights in a way that improves the accuracy of future predictions. This process may continue until the difference between the prediction and the correct targets is minimal.

Once a neural network is trained (e.g., inference), the formation prediction module 120 may identify assigned positions of each racer in a formation and label images to identify and predict the position of each racer in the formation within the images. Specifically, the formation prediction module 120 contains a trained neural network configured to identify and generate a racer position identifier identifying a position of the racer in the formation in a plurality of images. As such, the formation prediction module 120 is trained to identify at least a predicted assigned position of each racer in the formation at a plurality of locations of the race course based at least in part on identifying visual appearances of each racer using a trained neural network. The trained neural network in the formation prediction module 120 may extract features from the images and identify patterns that correspond to racer positions. In some aspects, the formation prediction module 120 may utilize bounding box predictions to predict bounding boxes around each racer and assign labels indicating their position in the formation.

During inference, the trained formation prediction model from the formation prediction module 120 does not re-evaluate or adjust the layers of the neural network based on the results. Instead, the inference applies knowledge from the trained neural network and uses it to infer a result (e.g., predicted position in the formation of racers). Accordingly, when a new unknown dataset is input through the trained neural network in the formation prediction module 120, the trained neural network outputs a prediction of what positions each racer should be in within the racing formation based on predictive accuracy of the neural network.

In some aspects, the trained neural network from the formation prediction module 120 may also be executed to detect a deviation from the assigned position of each racer in the formation, determine a reason for the detected deviations, and calculate an impact of the deviations on a race performance of the group.

The optional geolocation generation module 122 contains a trained neural network configured to generate additional geolocation data to supplement the obtained geolocation data using a trained geolocation neural network model based at least in part on analyzing the obtained geolocation data.

Similar to training the neural network in the formation prediction module 120, the untrained neural network in the geolocation generation module 122 will analyze data from the training dataset and learn to supplement geolocation data using a training set comprising of geolocation data for racers and based on analyzing historical geolocation data of each racer. Accordingly, since the geolocation generation module 122 is designed to classify objects from different classes then the training dataset will need samples of every unique geolocation.

During training of the neural network, the geolocation training dataset is put through the untrained neural network from the geolocation generation module 122 and the results from the untrained neural network are then compared with known data set results (e.g., geolocation training set) using the labels.

The neural network in the geolocation generation module 122 then uses a loss function that quantifies the error between the predicted output and the ground truth (e.g., geolocation label) for a given training sample. In other words, the loss function can be used to guide the learning process by updating the network weights in a way that improves the accuracy of future predictions.

For image classification tasks such as the optional racer identification module 124, an untrained neural network in the racer identification module 124 will first analyze the images from the training dataset to identify racers in the images by learning and categorizing distinct visual appearances that define a particular racer. As an example, the training dataset may include labeled training data consisting of images of racers and their corresponding ground truth labels (e.g., identity of racer). Accordingly, since the racer identification module 118 is designed to classify objects from different classes (e.g., each individual racer), then the training data will need samples from every single racer that is to be identified. Typically, thousands of samples from each class may be required.

During training of the neural network in the racer identification module 124, the training dataset comprising images of the racers that are input through an untrained neural network in the racer identification module 124. The results from the untrained neural network are then compared with known data set results (e.g., racing training set) using the corresponding racer labels identifying each racer in the images. It should be noted that the input to the racer identification module 118 will only be the images from the training dataset.

For every input training sample from the training dataset, the neural network from the racer identification module 124 will produce a prediction consisting of values representing the probability that the input image corresponds to a given class (e.g., a given racer). The output with the highest probability determines the predicted racer label. A class label for each input image is used to compute a loss (e.g., loss function).

The racer identification module 124 then uses a loss function that quantifies the error between the predicted output and the ground truth (e.g., racer label) for a given training sample. In other words, the loss function can be used to guide the learning process by updating the network weights in a way that improves the accuracy of future predictions. This process may continue until the difference between the prediction and the correct targets is minimal.

Once a neural network is trained (e.g., inference), the racer identification module 124 may identify faces of racers or recognize physical attributes of the racers and label images to identify racers within the images. Specifically, the racer identification module 124 contains a trained neural network configured to identify and generate a racer visual identifier identifying racers in a plurality of images. As such, the racer identification module 124 is trained to identify at least one racer in the racing videos based at least in part on identifying visual appearances of each racer using a trained neural network. The trained neural network in the racer identification module 124 may use visual cues and appearances of the racers in images such as helmet color, uniform color, type of bicycle, color of bicycle, bid recognition, a uniform number assigned to the racer, or the like to identify individual racers.

During inference, the trained neural network racer from the identification module 124 does not re-evaluate or adjust the layers of the neural network based on the results. Instead, the inference applies knowledge from the trained neural network and uses it to infer a result (e.g., what racers are identified in an image). Accordingly, when a new unknown dataset (e.g., video feeds from the camera 102) is input through the trained neural network in the racer identification module 124, the trained neural network outputs a prediction of what racers are present in the videos based on predictive accuracy of the neural network.

In some aspects, the trained neural network from the racer identification module 124 may also be executed to generate a racer visual identifier for each racer that is continuously overlayed over playback of the racing videos by executing the trained racer identification neural network on each frame of the racing videos. The racer visual identifier overlayed on the video frames allow viewers of the videos to easily identify and track a particular racer throughout the duration of the race and across different video feeds.

The computing device 108 may also execute a formation statistics module 126 configured to determine at least one of: (i) any deviations by at least one racer from the assigned position within the formation, (ii) a reason for the deviation, and (ii) an impact of the deviation on the race performance of the group. For example, once the trained formation prediction module 120 predicts an assigned position of each racer in the formation at a plurality of locations of the race course; detects a deviation from the assigned position of each racer in the formation; determines a reason for the detected deviations, and calculates an impact of the deviations on a race performance of the group, the formation statistics module 126 may collect and present the results of the trained formation prediction module 120 to a user. In some examples, the formation statistics may further include at least one of: (i) a distance between other racers in the formation, (ii) overlapping coordinates of racers belonging to the same formation, (ii) changes in the distance between other racers in the formation, or (iv) a number of team connections.

In addition, the formation statistics module 126 may be configured to generate recommendations for improving the race performance of the group in different race conditions based on the detected deviations and the determined reasons for the deviations.

The computing device 108 may also execute a dynamic UI generation module 126 configured to receive inputs from a user and generate an interactive and dynamic UI that displays a digital map of the race course and a visual position identifier generated to identify and track a position of each racer in the formation along the race course on the digital map based on at least the geolocation data. The dynamic UI provides a singular UI for post-race video analysis that unites the synchronized race telemetry data, videos, and map. More details about the dynamic UI will be described below in FIG. 9.

It should be noted that the prediction of formation positions, identification of racers and unique geolocations described in the present disclosure are heavily simplified. One skilled in the art will appreciate that the neural networks utilized may have significantly large datasets with highly specific details. The analysis would be beyond the capabilities of the human mind because the amount of data to be identified and processed within the span of an image or short video clip is unfathomable. In addition, each short video clip may have dozens of racers to be distinguished and identified.

It should also be noted that although the present disclosure is described in terms of identifying racers for illustrative purposes only, methods and systems described in the present disclosure can be applied to any type of racers in a race such as runners, swimmers, race cars, motorcycles, drones, yachts, horses, or the like.

Figure 2:
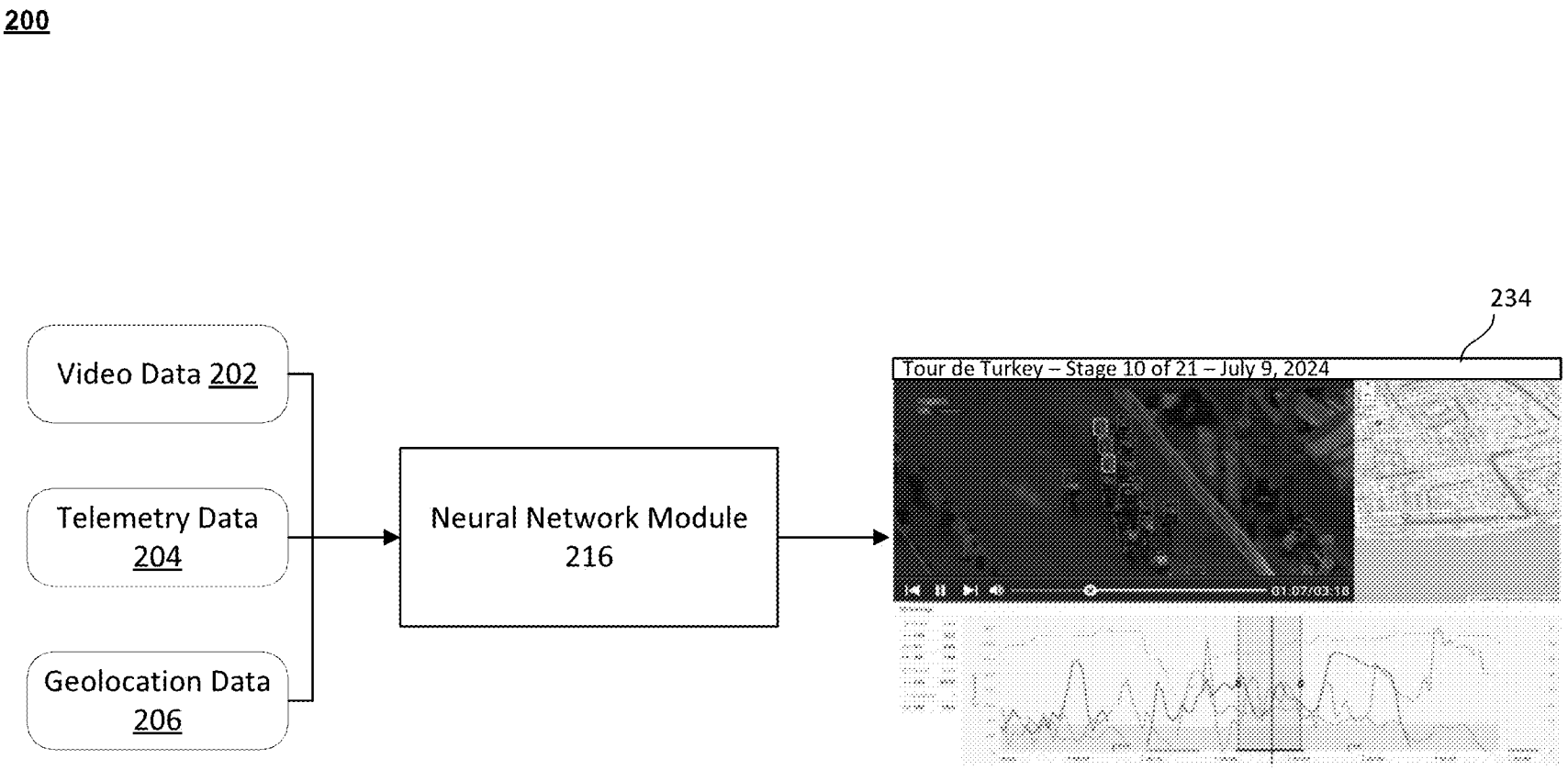
FIG. 2 is a diagram illustrating an approach of synchronizing video data, telemetry data, and geolocation data according to aspects of the present disclosure.

FIG. 2 is a diagram 200 illustrating a high-level approach of analyzing and synchronizing video data 202 (e.g., video feeds obtained from camera 102 from FIG. 1), telemetry data 204, and geolocation data 206 (e.g., obtained from the geolocation identification module 120 from FIG. 1 or the map 106) according to aspects of the present disclosure. In diagram 200, video data 202, telemetry data 204, and geolocation data 206 is synchronized using a neural network module 216 (e.g., the neural network module 118 shown in FIG. 1). The synchronized data is then united in a single dynamic UI 234 (e.g., generated from the dynamic UI generation module 126 shown in FIG. 1 and the dynamic UI 234 shown in FIG. 5). In addition, more detail about the dynamic UI 234 will be explained in more detail in FIG. 5.

Figure 3:
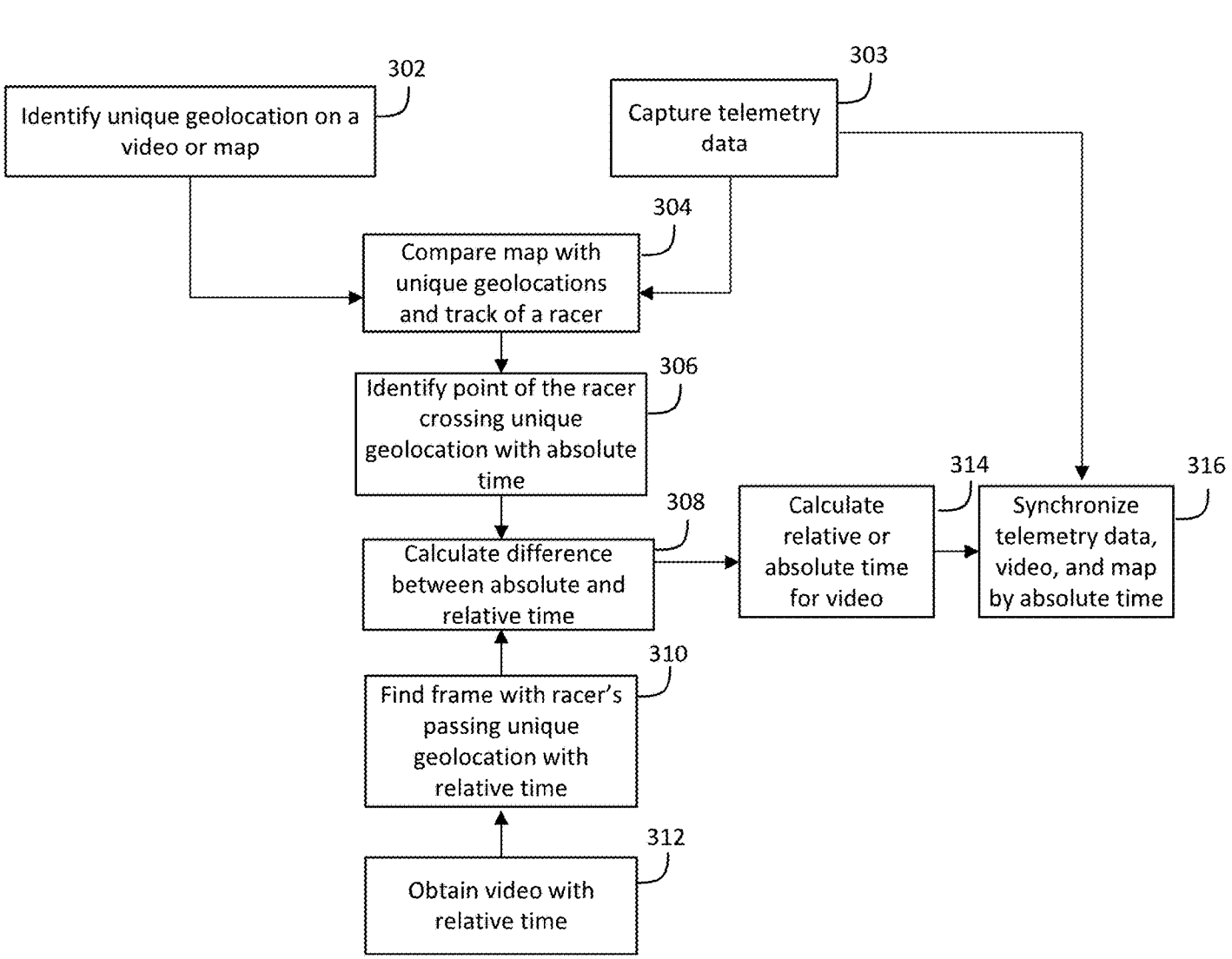
FIG. 3 is a flow chart illustrating a method of synchronizing telemetry race data with video based on absolute time according to aspects of the present disclosure.

FIG. 3 is a flow diagram of method 300 for synchronizing video, telemetry data, and map data. In various implementations, the method 300 is performed by a device with one or more processors and non-transitory memory that performs intent prediction. In some implementations, the method 300 is performed by processing logic, including hardware, firmware, software, or a combination thereof. In some implementations, the method 300 is performed by a processor executing code stored in a non-transitory computer-readable medium (e.g., a memory). Synchronization of video feeds, telemetry data, and map data allows users to perform video functions (e.g., searching, fast forwarding, rewinding) on video playback and display corresponding map location and telemetry data for each racer according to the video playback during post-race analysis.

At 302, the method 300 may include identifying unique geolocations on an image or from a map. In some aspects, the unique geolocations are identified using a trained geolocation identification neural network. In this case, the trained geolocation identification neural network may find and define categories and properties of the unique geolocations on the video and/or map. In some aspects, a user may identify unique geolocations on the video and/or map.

At 303, the method 300 may include capturing telemetry data (e.g., the collection module 112 shown in FIG. 1) from the racers.

At 304, the method 300 may include comparing the unique geolocations from the video and the map of a track of the race course to find coordinates of the unique geolocations for matching purposes. In some aspects, the method 300 may include extracting absolute time by matching coordinates of the unique geolocations with telemetry data of the racer by noting the time when coordinates of the racer is in the closest position or passing the coordinates of the unique geolocations.

At 306, the method 300 may include comparing a racer's track with a map with the identified unique geolocations by extracting absolute time related to a selected geolocation among the identified unique geolocation on the map. In some aspects, the method 300 may include extracting absolute time may be in Greenwich Mean Time (GMT) of the moment from the telemetry data.

At 312, the method 300 may include obtaining a video with a relative time scale (e.g., a streaming video). In some aspects, the method 300 may involve capturing several different streams such as aerial videos (e.g., helicopters or drones), helmet videos, bike videos, an accompanying car or moped video, or the like (e.g., via the camera 102 shown in FIG. 1).

At 310, the method 300 may include finding a precise frame with a moment that a racer crosses the unique geolocation, and taking the relative time from the frame, finds the moment of crossing the same unique geolocation from geo data from telemetry data. The method 300 may include, for each identified racer, matching telemetric data that is geographically located closest to an identified unique geolocation on the map.

At 308, the method 300 may include calculating a difference between the absolute time and relative time for the moment related to the racer passing an identified unique geolocation from the video. In some examples, the method 300 may include calculating the difference between the relative time and absolute time of the moment and implementing the different time scales for synchronization. In some aspects, implementing the different time scales may include plotting all data on a single timeline axis using the absolute time.

In some aspects, the method 300 may include extracting relative time related to the racer crossing or passing the identified unique geolocation from the video by marking the video frame with closest position and finding the time.

At 314, the method 300 may include determining relative time of the video to the telemetry data or determining absolute time for the video by summing up the difference and relative time of the video.

At 316, the method 300 may include synchronizing telemetry data, map, and video data by absolute time. In some aspects, the telemetry module 122 is configured to use a specialized neural network or automated method to synchronize telemetry data, videos, and the map. Synchronizing the telemetry data, map, and video data allows users to select telemetry data, a point of playback within a video, or location on map such that all the synchronized data is generated and synched simultaneously.

Figure 4:
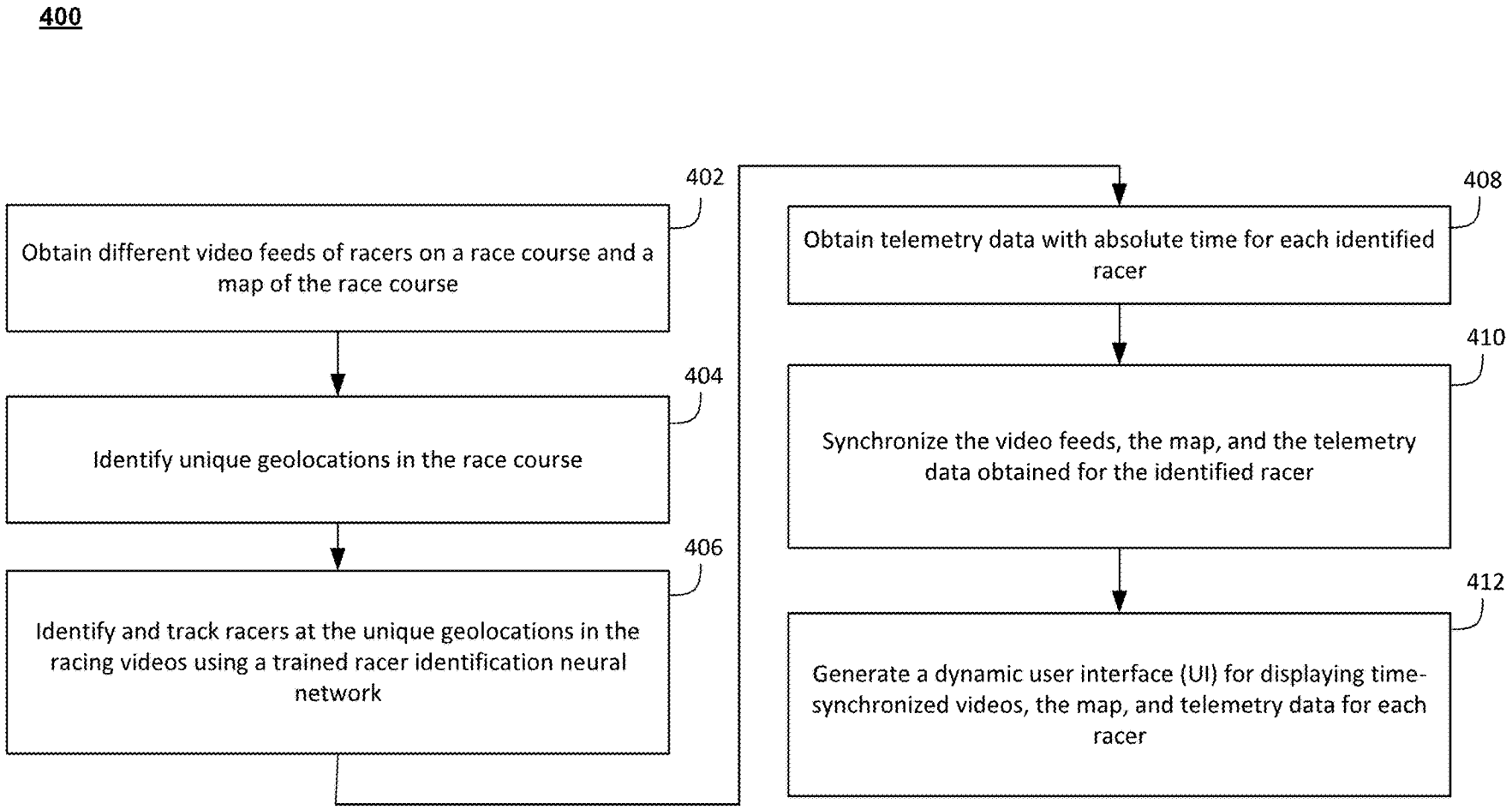
FIG. 4 is a flow diagram of a method for synchronizing race telemetry, video, and map data according to aspects of the present disclosure.

FIG. 4 is a flow diagram of a method 400 for synchronizing race telemetry, videos, and map data. In various implementations, the method 400 is performed by a device with one or more processors and one or more neural network modules (e.g., neural network module 118 shown in FIG. 1) that may include a racer identification module (e.g., racer identification module 24 shown in FIG. 1) and a dynamic UI generation module 126. In some implementations, the method 400 is performed by processing logic, including hardware, firmware, software, or a combination thereof. In some implementations, the method 400 is performed by a processor executing code stored in a non-transitory computer-readable medium (e.g., a memory). The method 400 describes a method of synchronizing race telemetry, videos, and map data by identifying racers and geolocations in videos.

At 402, the method 400 may include obtaining racing videos of racers on a race course and a map of the race course. As an example, referring back to FIG. 1, a plurality of videos of the racers on a race course may be obtained from different cameras 102 and stored on a cloud network 101 such that a collection module 112 may obtain the video feeds and digital map 106 from the cloud network 101.

At 404, the method 400 may include identifying unique geolocations of the race course in the racing videos and on the map of the race course. In some aspects, identifying the unique geolocations of the race course in the racing video and on the map may include: executing a trained geolocation identification neural network to identify the unique geolocations of the race course in the racing videos based at least in part on detecting visual appearances of: starting lights, traffic lights, a turn, a straight, a starting line, a finishing line, a pit stop, a location marker, an incline, a decline, a landmark, or a building along the race course, wherein the trained geolocation identification neural network is trained to visually detect and distinguish between different unique geolocations by learning categories and properties of different types of unique geolocations. As an example, referring back to FIG. 1, a geolocation identification module 120 may be trained to identify the one or more unique geolocations of the race course in the plurality of videos or the map.

In some aspects, identifying the unique geolocations of the race course in the racing videos and on the map of the race course may include: selecting unique geolocation of the race course on the racing videos, wherein the unique geolocation corresponds to starting lights, traffic lights, a turn, a straight, a starting line, a finishing line, a pit stop, a location marker, an incline, a decline, a landmark, or a building along the race course; identifying a same unique geolocation on the map of the race course; identifying coordinates of the same unique geolocation based on map data from the map or using an application programming interface (API) for a digital mapping service; and matching the identified coordinates of the selected unique geolocation to the videos.

At 406, the method 400 may include executing a trained racer identification neural network to visually identify and track at least one racer at least at the identified unique geolocations in the racing videos. In some aspects, the method 400 may include executing the trained racer identification neural network to identify at least one racer in the racing videos based at least in part on identifying visual appearances of each racer. In some aspects, the trained racer identification neural network may identify the at least one racer in the racing videos based on detecting a visual appearance of at least one of: a helmet color, a uniform color, a vehicle color, a vehicle type, or an assigned number of the racers learned from the trained racer identification neural network. As an example, referring back to FIG. 1, a racer identification module 124 may be trained to identify racers in images of the unique geolocations based on detecting visual appearances of the racer.

The trained racer identification neural network may be trained to distinguish between visual appearances and/or physiological characteristics of each racer using a training set comprising of images of racers and a racer label identifying each racer in the images. In some aspects, the method 400 may include the trained racer identification neural network being trained to identify the at least one racer in the racing videos based on analyzing historical data corresponding to images and videos of racers from previous races on different race courses. Using a training data set that contains images of the racers on different race courses will allow the trained racer identification neural network to identify patterns and features that are indicative of performance such as racing techniques (e.g., how racers handle different sections of the courses that may be similar to sections of a particular course) or course characteristics (e.g., unique features of different race courses that may impact racing strategies for the particular course). In addition, training the racer identification neural network on multiple race courses will help built a robust model that generalizes well to new and unseen data. This is important for ensuring that the model can handle a variety of race courses and/or conditions and to prevent the model from being too specialized to a specific set of conditions. As an example, referring back to FIG. 1, the neural network in the racer identification module 118 is trained to distinguish between visual appearances of each racer using a training dataset containing images of racers and a racer label identifying each racer in the images.

In some aspects, the method 400 may include the trained racer identification neural network being further trained to identify the at least one racer in the racing videos based on analyzing historical data corresponding to images and videos of racers from previous races on the same race course. In this way, the trained racer identification neural network may be highly specialized and trained to focus on a particular race course after training on a general larger training set (e.g., different race courses). Although training the neural network to only include images and videos of racers from the same race course may appear to be narrow, this type of training will highly specialize the neural network to identify the racers for that specific race course.

At 408, the method 400 may include obtaining telemetry data associated with absolute race time for each identified racer. In some aspects, the telemetry data with absolute time for each identified racer may be obtained from a device or sensor associated with each identified racer.

At 410, the method 400 may include synchronizing the racing videos, the map, and the telemetry data for each identified racer based on the identified unique geolocations and the absolute race time. In some aspects, synchronizing the racing videos, the map, and the telemetry data comprises: may include: determining a frame from the racing videos capturing a moment that the identified racer crosses an identified unique geolocation; obtaining a relative time from the determined frame; determining a moment that the identified racer crosses a same identified unique geolocation based on the obtained telemetry data from the identified racer; extracting the absolute race time by matching coordinates of the same unique geolocation with telemetry data; calculating a difference in the relative time and the absolute race time for the moment that the identified racer crosses the identified unique geolocation; and synchronizing the telemetry data of the racer and video data based on using the absolute race time. In some aspects, determining the frame from the racing videos capturing the moment that the identified racer crosses the identified unique geolocation and determining the moment that the identified racer crosses a same identified unique geolocation based on the obtained telemetry data from the identified racer may be performed by using the race identification module neural network trained to identify frames having both identified racers and identified unique geolocations.

As an example, a synchronization module may be configured to synchronizing the plurality of videos, the map, and the telemetry data for each racer based on the identified one or more unique geolocations and the absolute race time. Specifically, in some aspects, synchronizing includes: finding a precise frame with a moment of a racer crossing the unique geolocation, obtaining the relative time from this frame, determining the moment of crossing the same unique geolocation from geodata of the telemetry data of the racer, extracting the absolute (GMT) time of this moment from the telemetry data, calculating a difference in relative and absolute data, and implementing the difference for synchronization. In some aspects, this may mean plotting all data on one timeline axis (e.g., absolute timeline (GMT). In some aspects, finding the precise frame with the moment of the racer crossing the unique geolocation may be based on a trained special neural network. As another example, the synchronization module may be configured to find the precise frame with the moment of an identified racer crossing the unique geolocation using the trained racer identification neural network.

At 412, the method 400 may include generating a dynamic user interface (UI) for displaying time-synchronized videos comprising a visual identifier of each racer, the map including a visual identifier of a location of each racer on the race course, and the telemetry data for each racer. As an example, referring back to FIG. 1, the method 400 may include a dynamic UI generation module 128 that is configured to generate the dynamic UI for display on a computing device 108. As another example, referring to FIG. 5, the dynamic UI 234 may display first portion 502 showing a time-synchronized video playback of racers on the race course, a second portion 504 showing a map of the race, and a third portion 506 showing telemetry data for each racer according to the playback point of the time-synchronized video playback.

In some aspects, the dynamic UI may include: a video playback section for displaying playback of a racing video among the racing videos with at least one visual racer identifier generated to visually identify and track an individual racer throughout the playback of the racing video and across playback in the racing videos; a map section for displaying the map of the race course and a visual position identifier generated to identify and track a position of each identified racer along the race course on the map in accordance with the playback of the racing video in the video playback section of the dynamic UI, wherein the visual racer identifier shares at least one visual similarity as the visual position identifier, and a telemetry section for displaying the telemetry data associated with each identified racer in accordance with the playback of the racing video in the video playback section of the dynamic UI. As an example referring to FIG. 5, the dynamic UI may include a first portion 502 (e.g., playback video portion) with a racer visual identifier 510 (e.g., colored box) identifying and tracking a racer for the duration of the race, a second portion 504 (e.g., map portion) with a race course visual identifier 514 (e.g., visual identifier) generated to show the race course and a location visual identifier 516 corresponding to a racer, and third portion 506 (e.g., telemetry data) portion showing telemetry data 518 for the racers.

In some aspects, the method 400 may include: overlaying the visual identifier for each racer during playback of the time-synchronized video by executing the trained racer identification neural network on each frame of the time-synchronized video; andoverlaying the visual identifier of the geolocation of each racer on the race course by executing a trained geolocation identification neural network to identify the unique geolocations of the race course in the map based at least in part on detecting visual appearances of: starting lights, traffic lights, a turn, a straight, a starting line, a finishing line, a pit stop, a location marker, an incline, a decline, a landmark, or a building along the race course. In some aspects, the dynamic UI generation module 128 is configured to generate and overlay a racer visual identifier for each racer during playback of the time-synchronized video using the racer identification module 124 and to generate and overlay a position visual identifier showing the location of each racer on the map using a geolocation identification module. As an example, referring back to FIG. 5, the racer visual identifier 510 for each racer is overlayed during playback of the time synchronized video and a racer position identifier 516 for each racer is overlayed on the map.

In some aspects, the method 400 may include: obtaining a selection of a different playback point in the time-synchronized video; and updating the dynamic UI to display the time-synchronized videos comprising the visual identifier of each racer at the different playback point, the map including the visual identifier of the geolocation of each racer on the race course in accordance with the different playback point, and the telemetry data for each racer in accordance with the different playback point. As an example, referring back to FIG. 1, a user may use a computing device 108 and the UI 114 to obtain a selection of a different video and the dynamic UI generation module 126 will update the dynamic UI to reflect the selection of the video. As another example, referring back to FIG. 5, the user may use the search bar on 512 to select a particular point of the video for playback.

In some aspects, the method 400 may further include obtaining a telemetry data selection of at least one of: a heart rate, speed, power, cadence, or elevation data from the telemetry data; and updating the third portion of the dynamic UI for displaying a graph corresponding to the at least one of the heart rate, speed, power, cadence, or elevation data based on the telemetry data selection.

In some examples, the method 400 may further include executing a trained telemetry neural network to generate additional telemetry data to supplement the obtained telemetry data using a telemetry ML model based at least in part on analyzing the obtained telemetry data. The trained telemetry neural network may be trained to supplement telemetry data using a training set comprising of telemetry data for racers and based on analyzing historical telemetry data of each racer. This allows for improved synchronization quality between telemetry data and video data.

In some aspects, the method 400 may further include obtaining, in the first portion of the dynamic UI, a playback selection of a specific playback point in the video; and updating the first portion of the dynamic UI, the second portion of the UI, and the third portion of the UI based on the playback selection. As an example, referring back to FIGS. 1 and 5, a user may use the UI 114 to obtain a selection of a specific playback point using a progress bar 512 and the dynamic UI generation module 126 will update all portions of the dynamic UI to reflect the specific playback point.

In some aspects, the method 400 may further include obtaining, in the second portion of the dynamic UI, a location selection of the race course by moving the race position visual identifier 516 along the race course visual identifier 514 on the map and updating the first portion 502 of the dynamic UI and the third portion 506 of the dynamic UI based on the location selection. As an example, referring back to FIGS. 1 and 5, a user may use the UI 114 to drag the race position visual identifier 516 (e.g., showing a position of a racer) along the race course visual identifier 514 (e.g., showing the route of the race course on the map) and all corresponding portions of the dynamic UI will automatically update.

In some aspects, the method 400 may further include selecting an individual racer among the identified racers in the dynamic UI; and updating the first portion 502 of the dynamic UI, the second portion 504 of the dynamic UI, and the third portion 506 of the dynamic UI based on the racer selection.

Figure 5:
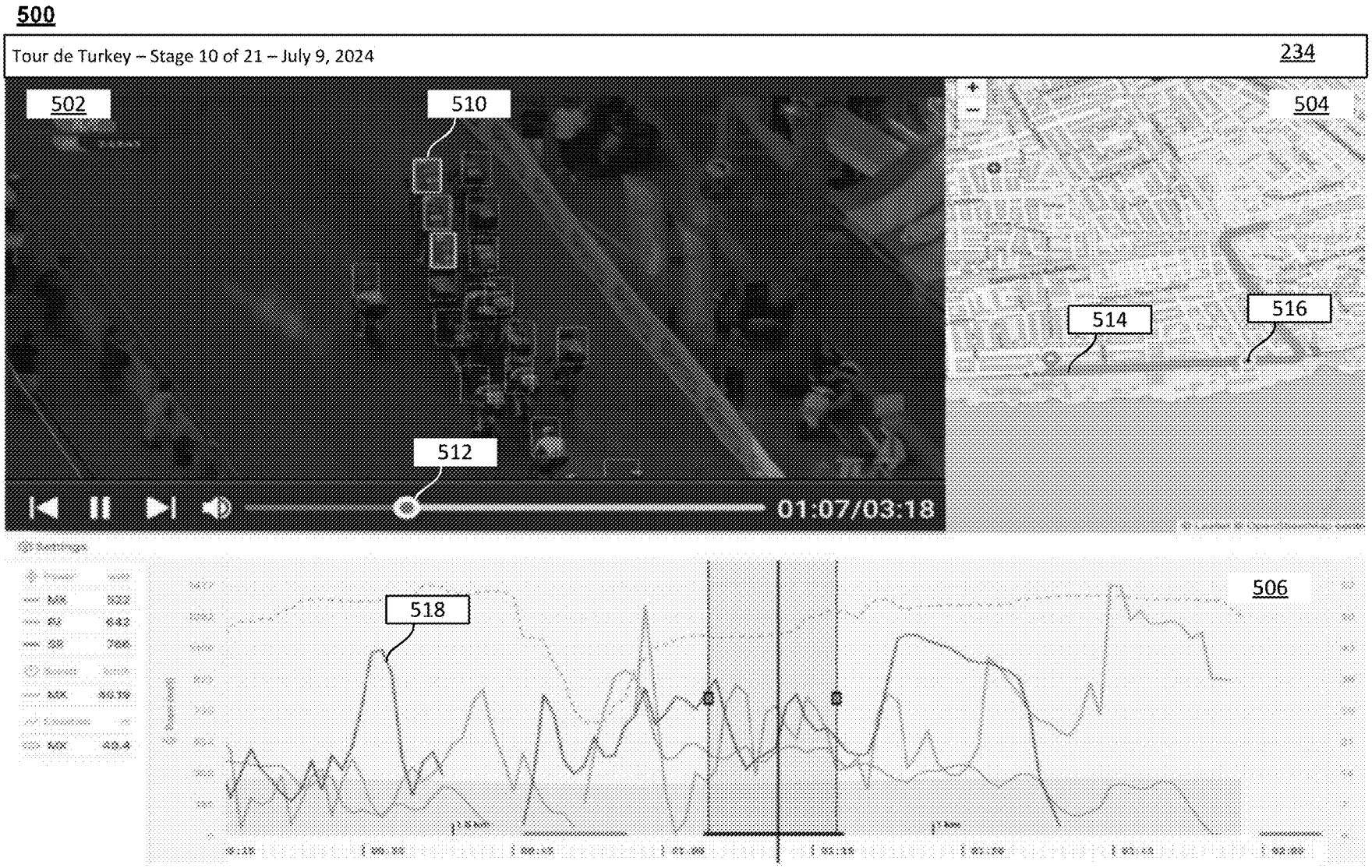
FIG. 5 presents an example dynamic user interface for presenting synchronized race telemetry, video, and map data for racers according to aspects of the present disclosure.

FIG. 5 is a diagram illustrating a dynamic UI for displaying time-synchronized videos, a map of the race course, and telemetry data for racers. As shown in example 500, the dynamic UI 234 includes a first portion 502 that displays a playback video of a race with racer visual identifiers 510 marking each racer, a second portion 504 that includes a display of the race course map with a race course visual identifier 514 marking the race course on the map and a race position visual identifier 516 showing position of the racers along the race course visual identifier 514 in accordance with the playback of the video, and a third portion 506 that displays telemetry data for each racer in accordance with the position of the racer along the race course. As discussed above, each portion of the UI contains data that is synchronized together such that changing a particular playback point in the video will update the display of the map and the telemetry data.

The first portion 502 of the dynamic UI includes an area for playing back time-synchronized videos from different video feeds of the race. In some aspects, the first portion 502 may include a playback bar that includes options to at least rewind, pause, fast forward, and a progress bar. In addition, the first portion will include at least one racer visual identifier 510 (e.g., colored boxes, colored arrows) visually distinguishing each racer throughout the entire race. The point of the racer visual identifier 510 is to identify and track racers throughout the duration of the race. Accordingly, each identified rider will have their own racer visual identifier 510 throughout playback of the video. Furthermore, if a user selects a different video feed, the same visual identifier 510 will be present on each video feed identifying the racer, which allows a user to more easily track racers across different video feeds. In some examples, an analyst may detect an unidentified rider on playback of the first portion 502 of the dynamic UI and add the unidentified rider as an identified rider.

The second portion 504 of the dynamic UI includes a display of the map of the race course with a race course visual identifier 514 (e.g., highlight of the race course along the map) generated to identify the race course along the map and a race position visual identifier 516 (e.g., a marker or visual indicator) to identify and track a position of a racer along the race course in accordance with playback of the video from the first portion 502. Accordingly, each identified rider will have their own first race course visual identifier throughout playback of the video. In some aspect, the race position visual identifier 516 for a particular racer will be visually similar (e.g., same color) to the racer visual identifier 510 in order for analysts to more easily track a particular racer along the map. In some aspects, a user may drag and drop the race position visual identifier 516 along the race course visual identifier 514 in order to review that particular point of the race. In response to the user selecting a particular point of the race, the dynamic UI will update to show a corresponding video playback showing that particular point of the race in the first portion 502 of the dynamic UI and telemetry data in a third portion 506 of the dynamic UI.

The third portion 506 of the dynamic UI includes a display of race telemetry data for each racer in accordance with the race position visual identifier 516 in the second portion of the dynamic UI. In some aspects, the telemetry data may be tagged with absolute time. In addition, the telemetry data 518 may be color matched or use a similar visual identifier to match the telemetry data to each respective identified racers. The third portion 506 of the dynamic UI may include multiple graphs showing each parameter for the identified racers.

In some aspects, the third portion 506 of the dynamic UI may include a display of selectable results, graphs, or data extracted or derived from the telemetry data 518. In this way, analysts and support members can find insight from reviewing the telemetry data 518. For example, an analyst may use the third portion 506 to measure the average and maximum value of metrics inside intervals. In addition, analysts may annotate and add text notes to capture their notes and commentary.

Each of the portions 502, 504, 506 of the dynamic UI are synchronized. For example, if a user selects a particular playback point in a video using a progress bar 512 in the first portion 502 of the dynamic UI, the race position visual identifier 516 showing a racer's position along the race course visual identifier 514 (e.g., the race track) in the second portion 502 of the dynamic UI and the telemetry data 518 in the third portion 506 of the dynamic UI will all update in accordance with the particular playback point.

Figure 6:
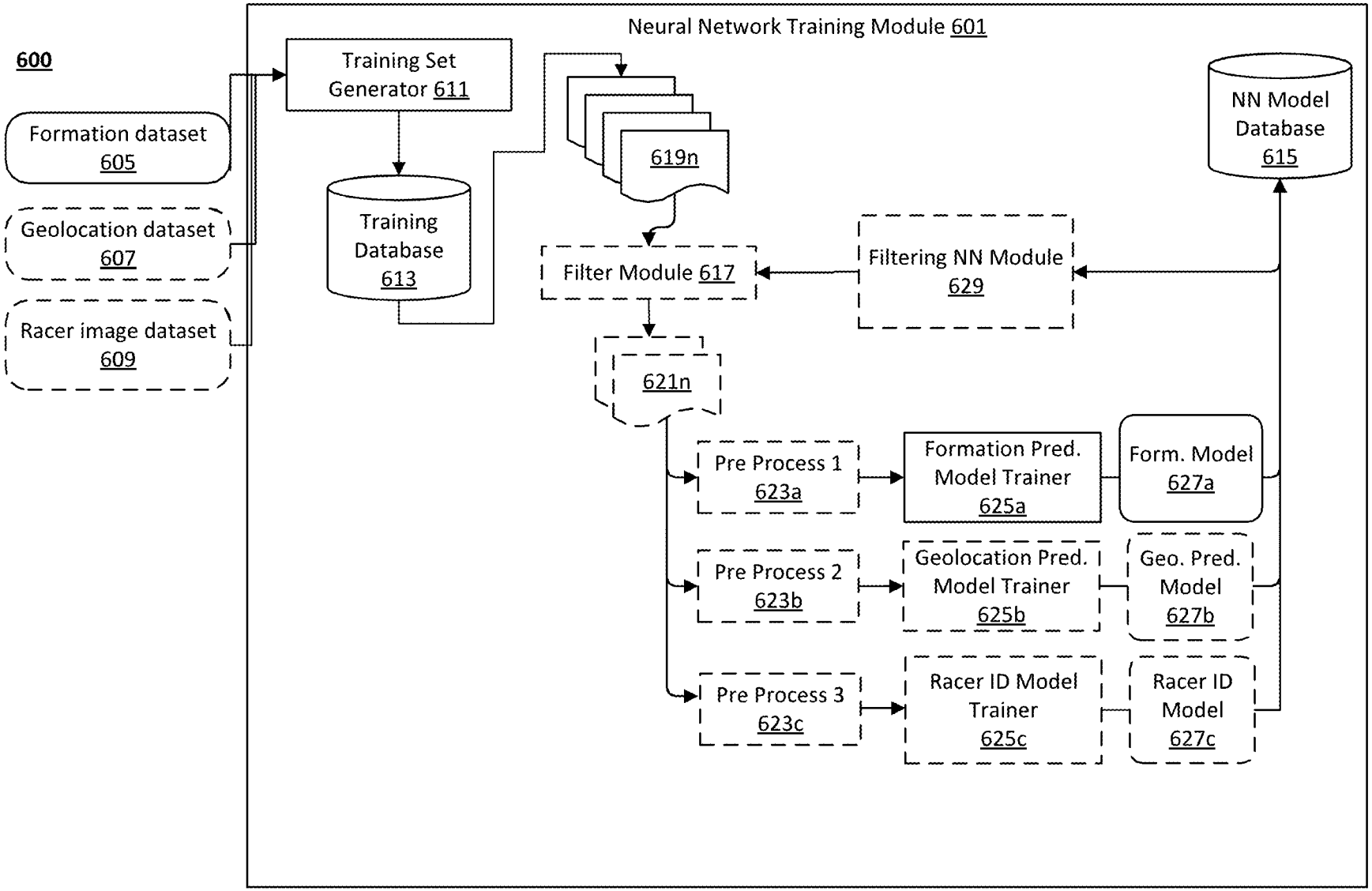
FIG. 6 is a block diagram illustrating a system for training neural networks to monitor a formation of racers according to aspects of the present disclosure.

FIG. 6 is a block diagram of a neural network training pipeline according to aspects of the present disclosure. As shown in the example 600 as shown in FIG. 6, a neural network training module 601 is configured to build and train specialized neural networks with inference to predict an assigned position of a racer in a formation, supplement geolocation data, and/or identity racers from video feeds. This enables the specialized neural network models to develop an ability to predict an assigned position of the racer in a racing formation within new images and videos that are not part of a training dataset. By subjecting the specialized neural network models to large amounts of labeled trained image data sets, the specialized neural network models may predict an assigned position of the racer in a racing formation within images based on supervised learning.

Supervised learning is effective for tasks such as classification (assigning inputs to predefined categories) and regression (predicting continuous values) since it relies on the availability of labeled data for both training and evaluation phases. In supervised learning, the neural network training module 601 trains the algorithm on a labeled dataset, where each input has a corresponding output. The goal is to learn a mapping function from inputs to outputs, allowing the algorithm to make predictions or classifications on new, unseen data. The process typically involves the following steps: training, model building, prediction, feedback, and adjustment. In the training phase, the neural network training module 601 provides the algorithm with a training dataset including input-output pairs. The algorithm learns the mapping function that relates inputs to outputs through an iterative process, adjusting its internal parameters based on the provided examples. During model building, the algorithm creates a model that can generalize from the training data to make predictions on new, unseen data. The model's complexity varies based on the algorithm used. For example, the model may be a simple linear regression model or a complex neural network. During the prediction phase, the neural network training module 601 inputs test inputs (i.e., inputs with known outputs) into the model, which generates predictions or classifications based on what it has learned during training. The accuracy of predictions is evaluated by comparing them to the known outputs in a validation or test dataset. During the feedback and adjustment phase, the neural network training module 601 refines the model based on feedback from its predictions. If the predictions differ from the actual outputs, the algorithm adjusts its internal parameters to minimize the errors. The performance of the trained model is assessed using metrics such as accuracy, precision, recall, etc., depending on the nature of the problem.

In some aspects, the neural network training module 601 contains at least a training database 613 configured to store the raw training data 619*n* and corresponding labels, a neural network model database 615 to store the trained models (e.g., formation model 627*a*, geolocation prediction model 627*b*, and a racer identification model 627*c*), and an optional filter module 617 configured to filter data from the training database 613 for training by removing bad training data.

Training data from the formation dataset 605, geolocation image dataset 607, and racer image dataset 609 is received into the neural network training module 601 via the training set generator 611. In some aspects, the formation dataset 605 includes historical data of videos of formations of racers from previous races on the same race course. In some aspects, the formation dataset 605 includes historical data of videos of formations of racers from previous races on a different race course.

An optional filter module 617 is configured to filter out bad training data in order to claim up the training data in the training dataset 619*n*. In some examples, the filter module 617 may be a neural network. In some examples, the filter module 617 is a simple mathematical model. In some examples, the cleaned training dataset 621*n* then undergoes optional preprocessing steps depending on which neural network or model is being trained.

The optional preprocess 1 623*a*, preprocess 2 623*b*, and preprocess 3 623*c* are automated processes that modify the raw data received from 619*n* (or cleaned training dataset 621*n*) and prepare the raw data as input to the respective model trainers (e.g., a formation prediction model trainer 625*a*, a geolocation prediction model trainer 625*b*, and a racer identification model trainer 625*c*). These may be described in the neural network training module 601 as snippets of code that prepares the datasets. In some examples, the preprocessing module (e.g., preprocess 1 623*a*, preprocess 2 623*b*, and a preprocess 3 623*c*) for a particular trainer may be an automated script or code that will be setup the first time any model is trained.

The formation prediction model trainer 625*a*, a geolocation prediction model trainer 625*b*, and a racer identification model trainer 625*c* are the scripts or code that train the model. The formation prediction model trainer 625*a*, a geolocation prediction model trainer 625*b*, and a racer identification model trainer 625*c* may be a script or code that holds the instructions on how a model should be trained (e.g., optimization method, model architecture, dataset division, etc.) and also runs the training. The formation prediction model trainer 625*a*, a geolocation prediction model trainer 625*b*, and a racer identification model trainer 625*c* each take as input the raw or filtered processed training data and train the formation prediction model 627*a*, the geolocation prediction model 627*b*, and the racer identification model 627*c* to achieve their specific objectives.

In summary, the raw dataset 619*n* or cleaned dataset 621*n* may optionally go through different preprocessing steps 623*a* and 623*b* and then a corresponding formation prediction model trainer 625*a*, a geolocation prediction model trainer 625*b*, and a racer identification model trainer 625*c* to generate a trained formation prediction model 627*a*, a trained geolocation prediction model 627*b*, and a trained racer identification model 627*c*. In some examples, each of these models may be a neural network.

As explained above in the neural network module 118 from FIG. 1, the neural network models are designed using a set of hyperparameters that define high-level aspects of their architecture and training process. These hyperparameters include, but are not limited to a combination of architecture type, number of layers, memory size, number of attention heads, learning rate, batch size, optimization algorithm, and the like. Based on these hyperparameters, learn-able variables called parameters are initialized, which define the mathematical function that the neural network represents.

The raw training dataset 619*n* used for training may contain noise and bad training images from the training database 613. Accordingly, to create a clean and filtered training dataset, the filter module 617 is configured to filter out unwanted data points from the raw training dataset 619*n* by developing smaller, less accurate systems based on patterns and metadata information. For example, an automated system may be created to differentiate between different racers based on the visual appearances used by the first neural network to identify individual racers comprises at least one of: a helmet color, uniform color, vehicle color, vehicle type, or a number assigned to the racer. The resulting training dataset 619*n* may consist of images and labels, where each image is labeled with a corresponding label such as racer name or geolocation name.

During the training process, the formation prediction model 627*a*, the geolocation prediction model 627*b*, and the racer identification model 627*c* (e.g., neural networks) are presented with images and labels, and the optimization objective, which aims to minimize the difference between the actual value and the predicted value, is calculated. The optimization algorithm updates the parameters of the formation prediction model 627*a*, the geolocation prediction model 627*b*, and the racer identification model 627*c* to reduce the value of the objective. This process is repeated for several iterations until the parameters do not change anymore. This process is repeated for various combinations of hyperparameters, and the model with the smallest label prediction error is selected as the final model.

When a new model (e.g., a trained formation prediction model 627*a*, a trained geolocation prediction model 627*b*, and a trained racer identification model 627*c*) is created, and a new process for filtering and automated labeling is established, it is added to the neural network model database 615 in the neural network training module 601. This enables the new model to be part of the closed-loop model update process. Optionally, at regular intervals, data which is continuously collected can be filtered, labeled, and used to update old models by an optional filtering neural network module 629. In some examples, the filtering neural network module 629 is a neural network. In some examples, the filtering neural network module 629 is a simple mathematical model. This approach may capture changes in the appearance of racers and/or unique geolocations over time. However, if the visual appearances of the racers and/or geolocations remain consistent, the existing large-scale data should be sufficient, and new data may not bring significant additional information.

Figure 7:
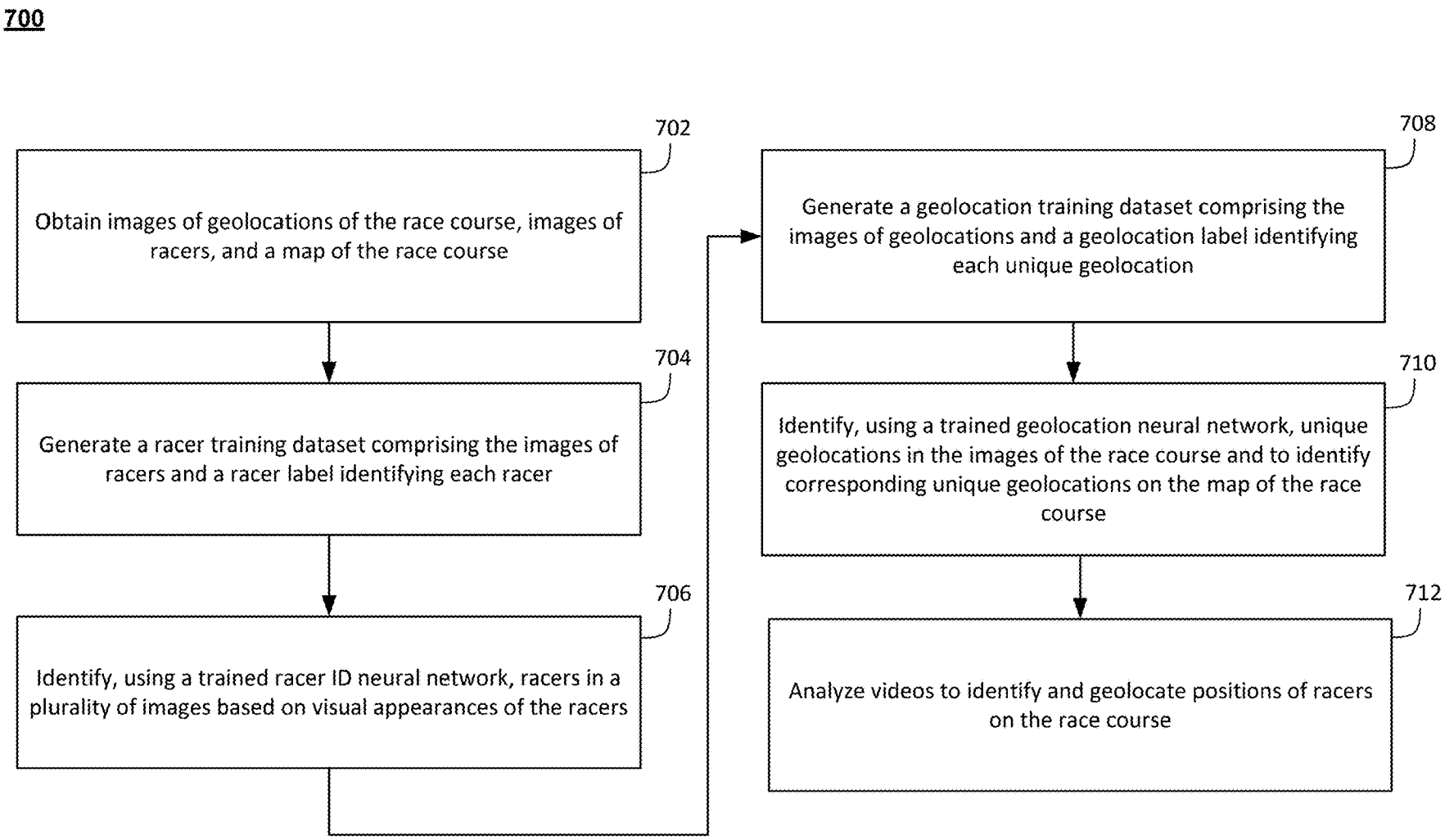
FIG. 7 is a flow diagram of a method for training neural networks to identify and geolocate racers according to aspects of the present disclosure.

FIG. 7 is a flow diagram of a method 700 for training neural networks to identify and geolocate racers. In various implementations, the method 700 is performed by a device with one or more processors and one or more neural network modules that may include an identification module (e.g. racer identification module 118, optional geolocation identification module 120 shown in FIG. 1, or optional telemetry neural network (not pictured)), and a synchronization module (e.g., a synchronization module 124 shown in FIG. 1). In some implementations, the method 700 is performed by processing logic, including hardware, firmware, software, or a combination thereof. In some implementations, the method 700 is performed by a processor executing code stored in a non-transitory computer-readable medium (e.g., a memory). The method 700 describes a method of training neural networks to identify and geolocate positions of racers on a race course in videos using neural networks.

At 702, the method 700 may include obtaining a first dataset comprising images of a race course, a second dataset comprising images of racers, and a map of the race course with unique geolocations. As an example, referring back to FIG. 6, a training set generator 611 may obtain a racer image dataset 605, a geolocation image dataset 607, and a map dataset 609.

At 704, the method 700 may include generating a first training dataset comprising the first dataset and geolocation labels identifying the unique geolocations. As an example, referring back to FIG. 6, the training set generator 611 may generate a first training dataset 619*n* comprising images of racers and a racer label identifying racers in the images.

At 706, the method 700 may include training a geolocation identification neural network to identify at least one unique geolocation in the images of the race course and to identify corresponding unique geolocations on the map of the race course.

In some aspects, the geolocation identification neural network may be trained to identify the unique geolocations based on detecting, in the first dataset, a visual appearance of at least one of: starting lights, traffic lights, a turn, a straight, a starting line, a finishing line, a pit stop, a location marker, an incline, a decline, a landmark, or a building. In some aspects, the geolocation identification neural network may be further configured to output a first confidence value for each identification of a unique geolocation in the first dataset.

As an example, referring back to FIG. 6, a geolocation identification model trainer 625*b* may train a neural network to identify at least one unique geolocation in a plurality of training images (e.g., cleaned training dataset 621*n*) based on identifying visual appearances of geolocations within the plurality of training images (cleaned training dataset 621*n*) and to identify corresponding unique geolocations on the map of the race course.

At 708, the method 700 may include generating a second training dataset comprising the second dataset and racer labels identifying each racer in the images of racers. As an example, referring back to FIG. 7, the training set generator 611 may generate a second training dataset 619*n* comprising images of plurality of images of a race course and a unique geolocation label identifying geolocations in the images.

At 710, the method 700 may include training a racer identification neural network to identify at least one racer in the images of racers based at least in part on identifying visual appearances of each racer. In some aspects, the racer identification neural network may be trained to identify racers in the second dataset based on detecting, in the second dataset, a visual appearance of at least one of: racer's face, a helmet color, uniform color, vehicle color, vehicle type, or a number assigned to each racer. In some aspects, the racer identification neural network may be further configured to output a second confidence value for each identification of each racer.

In some aspects, the trained racer identification neural network is trained to identify the at least one racer in the racing videos based on analyzing historical data corresponding to images of racers from previous races on the same race course.

As an example, referring back to FIG. 6, a racer identification model trainer 625*a* may train a neural network to identify at least one racer in a plurality of training images based on identifying visual appearances of racers within the plurality of training images.

At 712, the method 700 may include using the trained geolocation identification neural network and the trained racer identification neural network to analyze racing videos to identify and geolocate positions of racers on the race course.

In some aspects, the method 700 may include training a telemetry neural network to generate additional telemetry data to supplement obtained telemetry data based at least in part on analyzing obtained telemetry data. In some aspects, the trained telemetry neural network is trained to supplement the obtained telemetry data based on analyzing historical data corresponding to obtained telemetry data of racers from previous races on the same race course.

In some aspects, the geolocation identification neural network and the racer identification neural network are trained for a particular race course by inputting only images from the first dataset and the second dataset of the particular race course.

In some aspects, the first neural network and the second neural network, are hosted on a cloud server. As an example, referring back to FIG. 1, the neural network module 116 containing the racer identification module 118 and the geolocation identification module 120 may be hosted on a cloud network 101.

Figure 8:
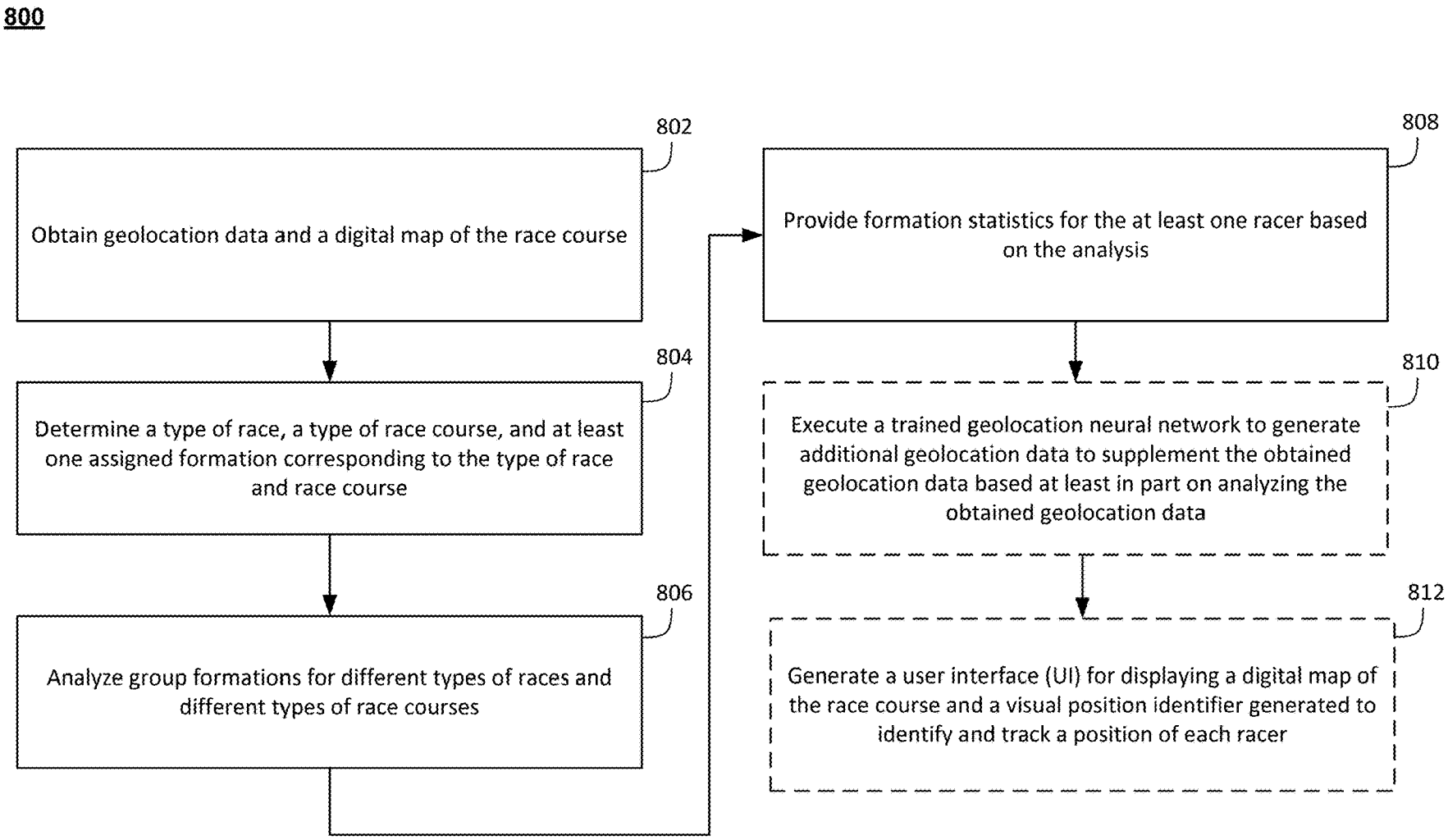
FIG. 8 is a flow diagram of a method for an artificial intelligence (AI)-based monitoring of a formation of racers according to aspects of the present disclosure.

FIG. 8 is a flow diagram of a method 800 for an artificial intelligence (AI)-based monitoring of a formation of racers. In various implementations, the method 800 is performed by a device with one or more processors and one or more neural network modules that may include an neural network module (e.g. formation prediction module 120, optional geolocation generation module 122, or optional racer identification module 124), a race type/course determination module (e.g., a race type/course determination module 116), and a formation statistics module (a formation statistics module 126). In some implementations, the method 800 is performed by processing logic, including hardware, firmware, software, or a combination thereof. In some implementations, the method 800 is performed by a processor executing code stored in a non-transitory computer-readable medium (e.g., a memory). The method 800 describes a method of training neural networks to monitor a formation of racers within a racing formation.

At 802, the method 800 may include obtaining geolocation data for a group of racers on a race course and a digital map of the race course configured to track movement of the group of racers in a formation along a plurality of locations of the race course.

At 804, the method 800 may include determining a type of race and a type of race course, and at least one assigned formation for the group of racers corresponding to the type of race and the race course along a plurality of locations of the race course.

In some aspects, determining the at least one assigned formation of the group of racers further comprises: calculating a movement direction for each racer from a first location on the race course to a second location on the race course using the geolocation data; and determining a position for at least one racer from the group of racers relative to positions of other racers belonging to the same formation.

At 806, the method 800 may include analyzing the digital map of the race course and the geolocation data of racers at the plurality of locations of the race course using a trained formation neural network trained to analyze group formations for different types of races and different types of race courses. In some aspects, the trained formation neural network is configured to: predict an assigned position of each racer in the formation at a plurality of locations of the race course; detect a deviation from the assigned position of each racer in the formation; determine a reason for the detected deviations, and calculate an impact of the deviations on a race performance of the group.

In some aspects, the trained formation neural network is further configured to generate recommendations for improving the race performance of the group in different race conditions based on the detected deviations and the determined reasons for the deviations.

In some aspects, predicting the assigned position of each racer in the formation at the plurality of locations of the race course further comprises: inputting racer-specific features for each racer into the trained formation neural network to predict a future position of each racer at the plurality of locations on the race track, wherein the racer-specific features correspond to at least one of: a current position, a current velocity, a current acceleration, a skill level, speed, historical positions, velocities at previous locations on the race track, or accelerations at previous locations on the race track, wherein the trained formation neural network data is trained to predict the future position of each racer based on a training dataset for each racer comprising at least lap times, previous racer positions at different locations of the race course, and velocities at different locations of the race course, and obtaining an output of a relative position of each racer at future time steps or a at each location of the race course on the digital map based on the result of the trained formation neural network. In some aspects, the trained formation neural network is trained to predict the assigned position of each racer in the formation at a plurality of locations of the race course based on analyzing historical data of videos of formations of racers from previous races on the same race course.

In some aspects, the trained formation neural network is trained to predict the assigned position of each racer in the formation at a plurality of locations of the race course based on analyzing historical data of videos of formations of racers from previous races on the difference race courses.

In some aspects, detecting the deviation from the assigned position of each racer in the formation further comprises: inputting racer-specific features, race course features, and interactions for each racer into the trained formation neural network to learn a normal pattern of positions of the racers in the formation and to identify deviations from the assigned position of the racer, wherein the racer-specific features correspond to at least one of: a current position, a past position, a current velocity, a past velocity, a current acceleration, a past velocity, assigned position, actual position, physical characteristics of the racer, or behavioral characteristics of the racer, wherein the race course features correspond to at least a location on a track, track conditions, track segments (e.g., straight, curve, elevation, etc.), or environmental factors (e.g., weather conditions, slippery track surface, hot track surface, etc.), wherein the interactions correspond to relative positions (e.g. formation gaps, spacing, etc.) of other racers in the formation, history of events (e.g., overtakes, collisions, etc.), or racing strategy (e.g., pit stops, fuel levels, tire condition, etc.), and obtaining an output of a deviation score for each racer at each time step or at each location of the race course on the digital map based on the result of the trained formation neural network.

In some aspects, determining a reason for the detected deviations further comprises: obtaining a label and a deviation feature for each racer at each time step or at each location of the race course on the digital map based on the result of the trained formation neural network, wherein the label may correspond to at least one of: speed adjustment, avoiding collision, tire wear, mechanical failure, track condition effect, weather impact, pit stop strategy, or overtake attempt, wherein the deviation feature corresponds to at least one of magnitude and frequency of deviations from the assigned position for each racer, or a duration spent deviating from the assigned position.

In some aspects, calculating the impact of the deviations on the race performance of the group further comprises: using a regression task to predict a metric that quantifies an overall race performance for the group of racers based on the deviation feature of each racer from the assigned positions, wherein the metric comprises at least one of: (i) total race time, (ii) average speed, or (iii) success rate.

At 808, the method 800 may include displaying, on a UI, a formation statistics for the at least one racer based on the analysis, wherein the formation statistics comprises at least one of: (i) any deviations by at least one racer from the assigned position within the formation, (ii) a reason for the deviation, and (ii) an impact of the deviation on the race performance of the group.

In some aspects, the formation statistics further comprise at least one of: (i) a distance between other racers in the formation, (ii) overlapping coordinates of racers belonging to the same formation, (ii) changes in the distance between other racers in the formation, or (iv) a number of team connections. Overlapping coordinates of racers belonging to the same formation means that if racer B is getting the same coordinates as racer A (e.g., who was heading to a particular position first) to check whether racer A and B are keeping the formation and how much they deviate. The number of team connections refers to how many racers are cycling or driving in one peloton (e.g., are they keeping the formation or group, or are they losing it).

Optionally, at 810, the method 800 may include: executing a trained geolocation neural network to generate additional geolocation data to supplement the obtained geolocation data using a geolocation neural network model based at least in part on analyzing the obtained geolocation data, wherein the trained geolocation neural network is trained to supplement geolocation data using a training set comprising of geolocation data for racers and based on analyzing historical geolocation data of each racer.

Optionally, at 812, the method 800 may include displaying, on the UI, a digital map of the race course and a visual position identifier generated to identify and track a position of each racer in the formation along the race course on the digital map based on at least the geolocation data.

In some aspects, the method 800 may include: obtaining at least one racing video of competitor racers on the race course; identifying unique geolocations of the race course in the racing videos and on the digital map of the race course; executing a trained racer identification neural network to visually identify and track at least one competitor racer corresponding to at least at an identified unique geolocations in the racing videos; synchronizing the racing video and the digital map for the identified at least one competitor to determine a position of the at least one competitor racer; analyzing the digital map of the race course, the geolocation data of racers at the plurality of locations of the race course, and the identified at least one competitor at the plurality of locations of the race course using a trained formation neural network; and provide, on a UI, the formation statistics for the at least one racer based on the analysis.

In some aspects, the method 800 may further include: executing the trained racer identification neural network to identify the at least one competitor racer in the at least one racing video based at least in part on identifying visual appearances of each racer, wherein the trained racer identification neural network is trained to distinguish between visual appearances of each racer using a training set comprising of images of racers and a racer label identifying each racer in the images.

Figure 9:
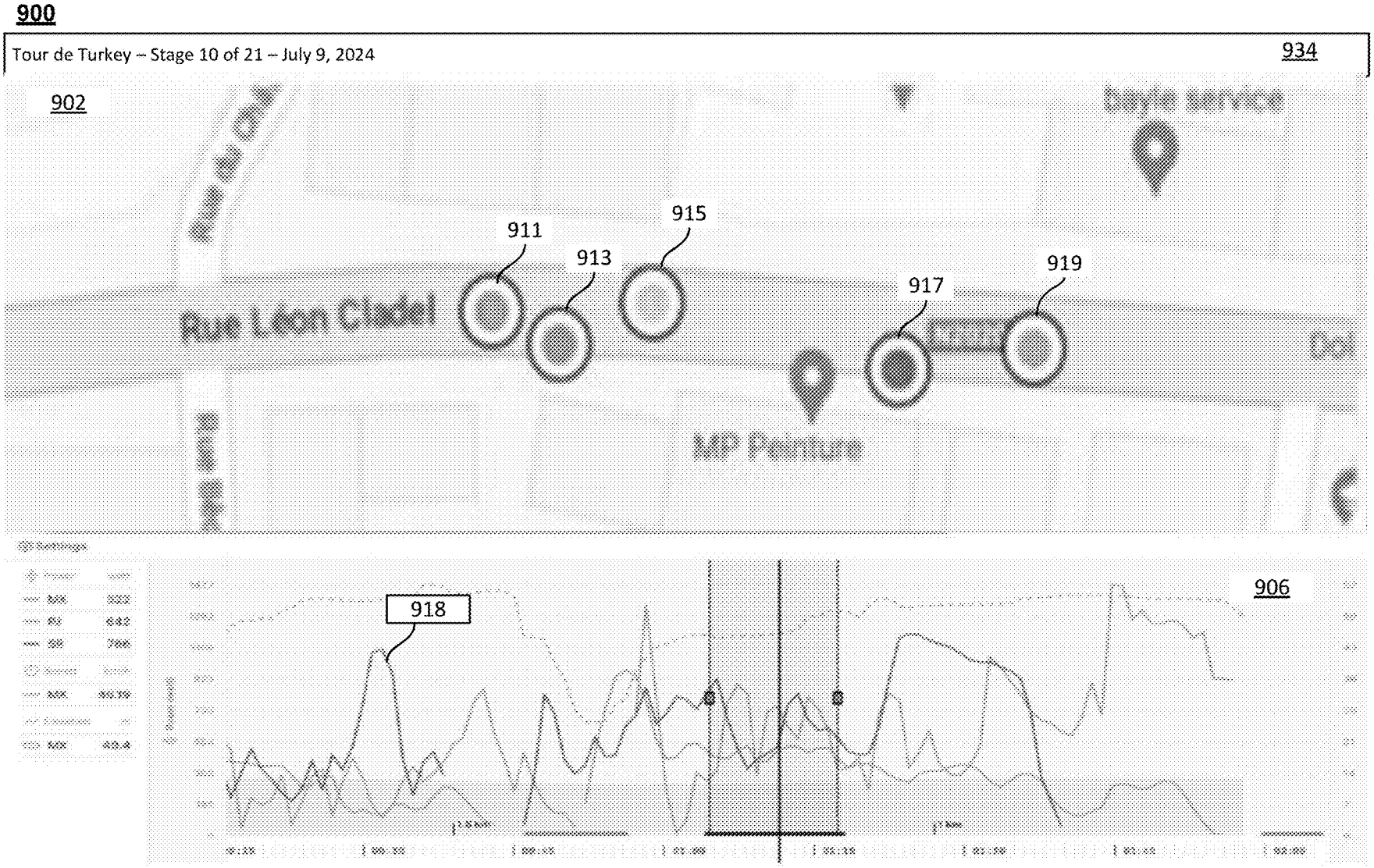
FIG. 9 presents an example dynamic user interface for presenting a formation of racers according to aspects of the present disclosure.

FIG. 9 presents an example dynamic user interface for presenting a formation of racers according to aspects of the present disclosure. As shown in example 900, the dynamic UI 934 may include a first portion 902 that displays a digital map showing positions of each racer in a formation with racer visual identifiers 911, 913, 915, 917, 919 marking each racer and a second portion 906 that displays telemetry data 918 in accordance with the position of the racer along the race course.

The first portion 902 of the dynamic UI includes a display of the map of the race course with race course showing positions of each racer in a formation with racer visual identifiers 911, 913, 915, 917, 919 to identify and track a position of a racer in their racing formation along the race course.

The second portion 906 of the dynamic UI includes a display of race telemetry data for each racer in accordance with the race position visual identifier in the first portion of the dynamic UI. In some aspects, the telemetry data may be tagged with absolute time. In addition, the telemetry data 918 may be color matched or use a similar visual identifier to match the telemetry data to each respective identified racers. The second portion 906 of the dynamic UI may include multiple graphs showing each parameter for the identified racers.

In some aspects, the second portion 906 of the dynamic UI may include a display of selectable results, graphs, or data extracted or derived from the telemetry data 918. In this way, analysts and support members can find insight from reviewing the telemetry data 918. For example, an analyst may use the second portion 906 to measure the average and maximum value of metrics inside intervals. In addition, analysts may annotate and add text notes to capture their notes and commentary.

Figure 10:
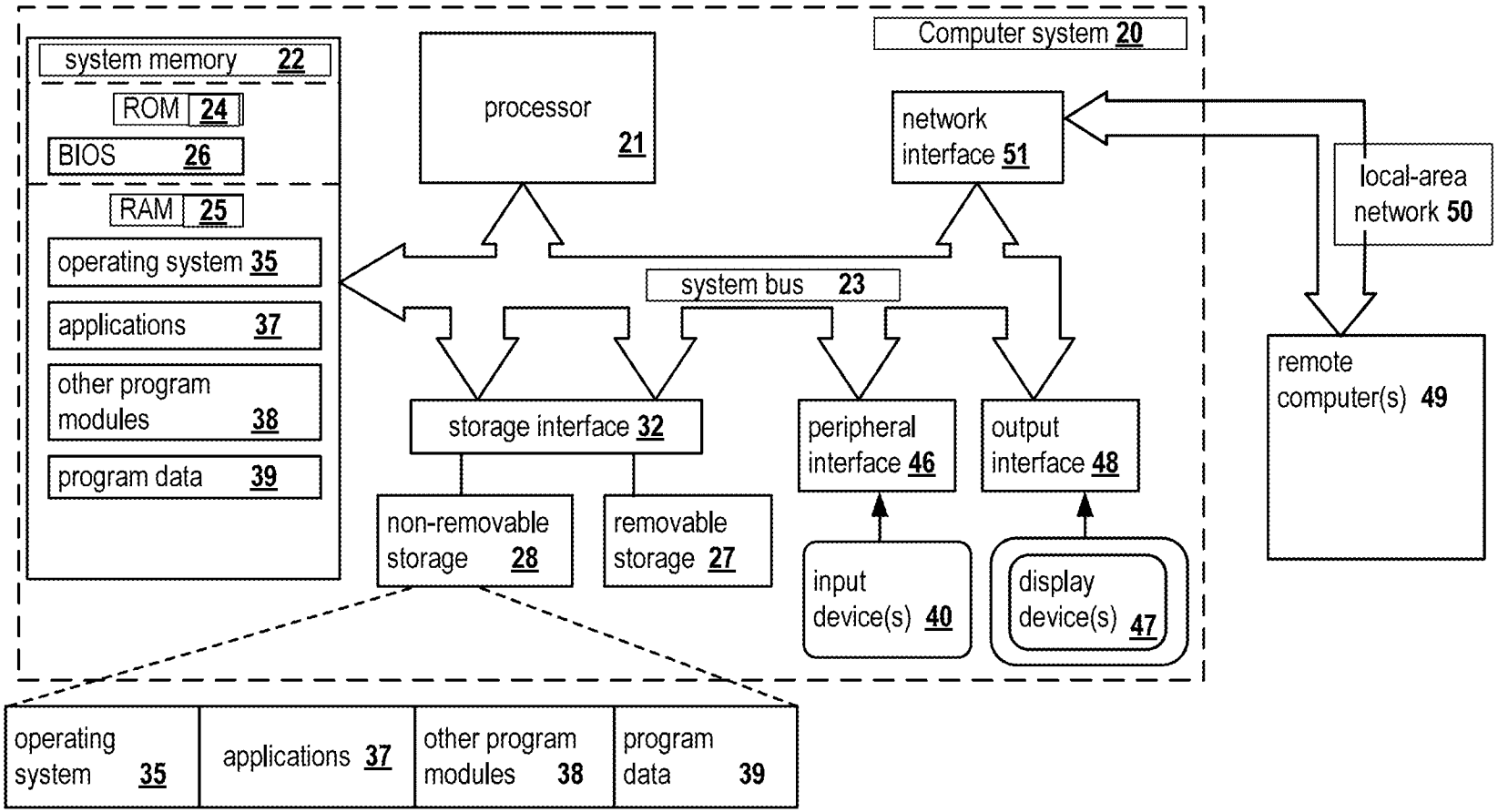
FIG. 10 presents an example of a general-purpose computer system on which aspects of the present disclosure can be implemented.

FIG. 10 is a block diagram illustrating a computer system 20 on which aspects of systems and methods for synchronizing race telemetry, video, and map data may be implemented. The computer system 20 can be in the form of multiple computing devices, or in the form of a single computing device, for example, a desktop computer, a notebook computer, a laptop computer, a mobile computing device, a smart phone, a tablet computer, a server, a mainframe, an embedded device, and other forms of computing devices.

As shown, the computer system 20 includes a central processing unit (CPU) 21, a system memory 22, and a system bus 23 connecting the various system components, including the memory associated with the central processing unit 21. The system bus 23 may comprise a bus memory or bus memory controller, a peripheral bus, and a local bus that is able to interact with any other bus architecture. Examples of the buses may include PCI, ISA, PCI-Express, HyperTransport™, InfiniBand™, Serial ATA, $I^2C$, and other suitable interconnects. The central processing unit 21 (also referred to as a processor) can include a single or multiple sets of processors having single or multiple cores. The processor 21 may execute one or more computer-executable code implementing the techniques of the present disclosure. For example, any of commands/steps discussed in FIGS. 1-7 may be performed by processor 21. The system memory 22 may be any memory for storing data used herein and/or computer programs that are executable by the processor 21.

The system memory 22 may include volatile memory such as a random access memory (RAM) 25 and non-volatile memory such as a read only memory (ROM) 24, flash memory, etc., or any combination thereof. The basic input/output system (BIOS) 26 may store the basic procedures for transfer of information between elements of the computer system 20, such as those at the time of loading the operating system with the use of the ROM 24.

The computer system 20 may include one or more storage devices such as one or more removable storage devices 27, one or more non-removable storage devices 28, or a combination thereof. The one or more removable storage devices 27 and non-removable storage devices 28 are connected to the system bus 23 via a storage interface 32. In an aspect, the storage devices and the corresponding computer-readable storage media are power-independent modules for the storage of computer instructions, data structures, program modules, and other data of the computer system 20. The system memory 22, removable storage devices 27, and non-removable storage devices 28 may use a variety of computer-readable storage media. Examples of computer-readable storage media include machine memory such as cache, SRAM, DRAM, zero capacitor RAM, twin transistor RAM, eDRAM, EDO RAM, DDR RAM, EEPROM, NRAM, RRAM, SONOS, PRAM; flash memory or other memory technology such as in solid state drives (SSDs) or flash drives; magnetic cassettes, magnetic tape, and magnetic disk storage such as in hard disk drives or floppy disks; optical storage such as in compact disks (CD-ROM) or digital versatile disks (DVDs); and any other medium which may be used to store the desired data and which can be accessed by the computer system 20.

The system memory 22, removable storage devices 27, and non-removable storage devices 28 of the computer system 20 may be used to store an operating system 35, additional program applications 37, other program modules 38, and program data 39. The computer system 20 may include a peripheral interface 46 for communicating data from input devices 40, such as a keyboard, mouse, stylus, game controller, voice input device, touch input device, or other peripheral devices, such as a printer or scanner via one or more I/O ports, such as a serial port, a parallel port, a universal serial bus (USB), or other peripheral interface. A display device 47 such as one or more monitors, projectors, or integrated display, may also be connected to the system bus 23 across an output interface 48, such as a video adapter. In addition to the display devices 47, the computer system 20 may be equipped with other peripheral output devices (not shown), such as loudspeakers and other audiovisual devices.

The computer system 20 may operate in a network environment, using a network connection to one or more remote computers 49. The remote computer (or computers) 49 may be local computer workstations or servers comprising most or all of the aforementioned elements in describing the nature of a computer system 20. Other devices may also be present in the computer network, such as, but not limited to, routers, network stations, peer devices or other network nodes. The computer system 20 may include one or more network interfaces 51 or network adapters for communicating with the remote computers 49 via one or more networks such as a local-area computer network (LAN) 50, a wide-area computer network (WAN), an intranet, and the Internet. Examples of the network interface 51 may include an Ethernet interface, a Frame Relay interface, SONET interface, and wireless interfaces.

Aspects of the present disclosure may be a system, a method, and/or a computer program product. The computer program product may include a computer readable storage medium (or media) having computer readable program instructions thereon for causing a processor to carry out aspects of the present disclosure.

The computer readable storage medium can be a tangible device that can retain and store program code in the form of instructions or data structures that can be accessed by a processor of a computing device, such as the computing system 20. The computer readable storage medium may be an electronic storage device, a magnetic storage device, an optical storage device, an electromagnetic storage device, a semiconductor storage device, or any suitable combination thereof. By way of example, such computer-readable storage medium can comprise a random access memory (RAM), a read-only memory (ROM), EEPROM, a portable compact disc read-only memory (CD-ROM), a digital versatile disk (DVD), flash memory, a hard disk, a portable computer diskette, a memory stick, a floppy disk, or even a mechanically encoded device such as punch-cards or raised structures in a groove having instructions recorded thereon. As used herein, a computer readable storage medium is not to be construed as being transitory signals per se, such as radio waves or other freely propagating electromagnetic waves, electromagnetic waves propagating through a waveguide or transmission media, or electrical signals transmitted through a wire.

Computer readable program instructions described herein can be downloaded to respective computing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network interface in each computing device receives computer readable program instructions from the network and forwards the computer readable program instructions for storage in a computer readable storage medium within the respective computing device.

Computer readable program instructions for carrying out operations of the present disclosure may be assembly instructions, instruction-set-architecture (ISA) instructions, machine instructions, machine dependent instructions, microcode, firmware instructions, state-setting data, or either source code or object code written in any combination of one or more programming languages, including an object oriented programming language, and conventional procedural programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a LAN or WAN, or the connection may be made to an external computer (for example, through the Internet). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

In various aspects, the systems and methods described in the present disclosure can be addressed in terms of modules. The term "module" as used herein refers to a real-world device, component, or arrangement of components implemented using hardware, such as by an application specific integrated circuit (ASIC) or FPGA, for example, or as a combination of hardware and software, such as by a microprocessor system and a set of instructions to implement the module's functionality, which (while being executed) transform the microprocessor system into a special-purpose device. A module may also be implemented as a combination of the two, with certain functions facilitated by hardware alone, and other functions facilitated by a combination of hardware and software. In certain implementations, at least a portion, and in some cases, all, of a module may be executed on the processor of a computer system. Accordingly, each module may be realized in a variety of suitable configurations, and should not be limited to any particular implementation exemplified herein.

In the interest of clarity, not all of the routine features of the aspects are disclosed herein. It would be appreciated that in the development of any actual implementation of the present disclosure, numerous implementation-specific decisions must be made in order to achieve the developer's specific goals, and these specific goals will vary for different implementations and different developers. It is understood that such a development effort might be complex and time-consuming, but would nevertheless be a routine undertaking of engineering for those of ordinary skill in the art, having the benefit of this disclosure.

Furthermore, it is to be understood that the phraseology or terminology used herein is for the purpose of description and not of restriction, such that the terminology or phraseology of the present specification is to be interpreted by the skilled in the art in light of the teachings and guidance presented herein, in combination with the knowledge of those skilled in the relevant art(s). Moreover, it is not intended for any term in the specification or claims to be ascribed an uncommon or special meaning unless explicitly set forth as such.

The various aspects disclosed herein encompass present and future known equivalents to the known modules referred to herein by way of illustration. Moreover, while aspects and applications have been shown and described, it would be apparent to those skilled in the art having the benefit of this disclosure that many more modifications than mentioned above are possible without departing from the inventive concepts disclosed herein.

What is claimed is:

1. A method for an artificial intelligence (AI)-based monitoring of a formation of racers, the method comprising:

obtaining geolocation data for a group of racers on a race course and a digital map of the race course configured to track movement of the group of racers in a formation along a plurality of locations of the race course;

determining a type of race and a type of race course, and at least one assigned formation for the group of racers corresponding to the type of race and the race course along a plurality of locations of the race course;

analyzing the digital map of the race course and the geolocation data of racers at the plurality of locations of the race course using a trained formation neural network trained to analyze group formations for different types of races and different types of race courses, wherein the trained formation neural network is configured to:

predict an assigned position of each racer in the formation at a plurality of locations of the race course;

detect a deviation from the assigned position of each racer in the formation;

determine a reason for the detected deviations, and calculate an impact of the deviations on a race performance of the group; and displaying, on a UI, a formation statistics for the at least one racer based on the analysis, wherein the formation statistics comprises at least one of: (i) any deviations by at least one racer from the assigned position within the formation, (ii) a reason for the deviation, and (ii) an impact of the deviation on the race performance of the group.

2. The method of claim 1, wherein determining the at least one assigned formation of the group of racers further comprises:

calculating a movement direction for each racer from a first location on the race course to a second location on the race course using the geolocation data; and determining a position for at least one racer from the group of racers relative to positions of other racers belonging to the same formation.

3. The method of claim 1, wherein the formation neural network is further configured to generate recommendations for improving the race performance of the group in different race conditions based on the detected deviations and the determined reasons for the deviations.

4. The method of claim 1, wherein the formation statistics further comprise at least one of: (i) a distance between other racers in the formation, (ii) overlapping coordinates of racers belonging to the same formation, (ii) changes in the distance between other racers in the formation, or (iv) a number of team connections.

5. The method of claim 1, wherein the trained formation neural network is trained to predict the assigned position of each racer in the formation at a plurality of locations of the race course based on analyzing historical data of videos of formations of racers from previous races on the same race course.

6. The method of claim 1, wherein the trained formation neural network is trained to predict the assigned position of each racer in the formation at a plurality of locations of the race course based on analyzing historical data of videos of formations of racers from previous races on the difference race courses.

7. The method of claim 1, wherein predicting the assigned position of each racer in the formation at the plurality of locations of the race course further comprises:

inputting racer-specific features for each racer into the trained formation neural network to predict a future position of each racer at the plurality of locations on the race track, wherein the racer-specific features correspond to at least one of: a current position, a current velocity, a current acceleration, a skill level, speed, historical positions, velocities at previous locations on the race track, or accelerations at previous locations on the race track, wherein the trained formation neural network data is trained to predict the future position of each racer based on a training dataset for each racer comprising at least lap times, previous racer positions at different locations of the race course, and velocities at different locations of the race course, and obtaining an output of a relative position of each racer at future time steps or a at each location of the race course on the digital map based on the result of the trained formation neural network.

8. The method of claim 1, wherein detecting the deviation from the assigned position of each racer in the formation further comprises:

inputting racer-specific features, race course features, and interactions for each racer into the trained formation neural network to learn a normal pattern of positions of the racers in the formation and to identify deviations from the assigned position of the racer, wherein the racer-specific features correspond to at least one of: a current position, a past position, a current velocity, a past velocity, a current acceleration, a past velocity, assigned position, actual position, physical characteristics of the racer, or behavioral characteristics of the racer, wherein the race course features correspond to at least a location on a track, track conditions, track segments, or environmental factors, wherein the interactions correspond to relative positions of other racers in the formation, history of events, or racing strategy, and obtaining an output of a deviation score for each racer at each time step or at each location of the race course on the digital map based on the result of the trained formation neural network.

9. The method of claim 8, wherein determining a reason for the detected deviations further comprises:

obtaining a label and a deviation feature for each racer at each time step or at each location of the race course on the digital map based on the result of the trained formation neural network, wherein the label may correspond to at least one of: speed adjustment, avoiding collision, tire wear, mechanical failure, track condition effect, weather impact, pit stop strategy, or overtake attempt, wherein the deviation feature corresponds to at least one of magnitude and frequency of deviations from the assigned position for each racer, or a duration spent deviating from the assigned position.

10. The method of claim 9, wherein calculating the impact of the deviations on the race performance of the group further comprises:

using a regression task to predict a metric that quantifies an overall race performance for the group of racers based on the deviation feature of each racer from the assigned positions, wherein the metric comprises at least one of: (i) total race time, (ii) average speed, or (iii) success rate.

11. The method of claim 1, further comprising:

executing a trained geolocation neural network to generate additional geolocation data to supplement the obtained geolocation data using a geolocation neural network model based at least in part on analyzing the obtained geolocation data, wherein the trained telemetry neural network is trained to supplement geolocation data using a training set comprising of geolocation data for racers and based on analyzing historical geolocation data of each racer.

12. The method of claim 11, further comprising:

displaying, on the UI, a digital map of the race course and a visual position identifier generated to identify and track a position of each racer in the formation along the race course on the digital map based on at least the geolocation data.

13. The method of claim 1, further comprising:

obtaining at least one racing video of competitor racers on the race course;

identifying unique geolocations of the race course in the racing videos and on the digital map of the race course;

executing a trained racer identification neural network to visually identify and track at least one competitor racer corresponding to at least at an identified unique geolocations in the racing videos;

synchronizing the racing video and the digital map for the identified at least one competitor to determine a position of the at least one competitor racer;

analyzing the digital map of the race course, the geolocation data of racers at the plurality of locations of the race course, and the identified at least one competitor at the plurality of locations of the race course using a trained formation neural network; and provide, on a UI, the formation statistics for the at least one racer based on the analysis.

14. The method of claim 13, further comprising:

executing the trained racer identification neural network to identify the at least one competitor racer in the at least one racing video based at least in part on identifying visual appearances of each racer, wherein the trained racer identification neural network is trained to distinguish between visual appearances of each racer using a training set comprising of images of racers and a racer label identifying each racer in the images.

15. A system for artificial intelligence (AI)-based monitoring of a formation of racers, comprising:

at least one memory; and at least one hardware processor coupled with the at least one memory and configured, individually or in combination, to:

obtain geolocation data for a group of racers on a race course and a digital map of the race course configured to track movement of the group of racers in a formation along a plurality of locations of the race course;

determine a type of race and a type of race course, and at least one assigned formation for the group of racers corresponding to the type of race and the race course along a plurality of locations of the race course;

analyze the digital map of the race course and the geolocation data of racers at the plurality of locations of the race course using a trained formation neural network trained to analyze group formations for different types of races and different types of race courses, wherein the trained formation neural network is configured to:

predict an assigned position of each racer in the formation at a plurality of locations of the race course;

detect a deviation from the assigned position of each racer in the formation;

determine a reason for the detected deviations, and calculate an impact of the deviations on a race performance of the group; and display, on a UI, a formation statistics for the at least one racer based on the analysis, wherein the formation statistics comprises at least one of: (i) any deviations by at least one racer from the assigned position within the formation, (ii) a reason for the deviation, and (ii) an impact of the deviation on the race performance of the group.

16. The system of claim 15, wherein determining the at least one assigned formation of the group of racers further comprises:

calculating a movement direction for each racer from a first location on the race course to a second location on the race course using the geolocation data; and determining a position for at least one racer from the group of racers relative to positions of other racers belonging to the same formation.

17. The system of claim 15, wherein the formation neural network is further configured to generate recommendations for improving the race performance of the group in different race conditions based on the detected deviations and the determined reasons for the deviations.

18. The system of claim 15, wherein the formation statistics further comprise at least one of: (i) a distance between other racers in the formation, (ii) overlapping coordinates of racers belonging to the same formation, (ii) changes in the distance between other racers in the formation, or (iv) a number of team connections.

19. The system of claim 15, wherein the trained formation neural network is trained to predict the assigned position of each racer in the formation at a plurality of locations of the race course based on analyzing historical data of videos of formations of racers from previous races on the same race course.

20. A non-transitory computer readable medium storing thereon computer executable instructions for artificial intelligence (AI)-based monitoring of a formation of racers, including instructions for:

obtaining geolocation data for a group of racers on a race course and a digital map of the race course configured to track movement of the group of racers in a formation along a plurality of locations of the race course;

determining a type of race and a type of race course, and at least one assigned formation for the group of racers corresponding to the type of race and the race course along a plurality of locations of the race course;

analyzing the digital map of the race course and the geolocation data of racers at the plurality of locations of the race course using a trained formation neural network trained to analyze group formations for different types of races and different types of race courses, wherein the trained formation neural network is configured to:

predict an assigned position of each racer in the formation at a plurality of locations of the race course;

detect a deviation from the assigned position of each racer in the formation;

determine a reason for the detected deviations, and calculate an impact of the deviations on a race performance of the group; and displaying, on a UI, a formation statistics for the at least one racer based on the analysis, wherein the formation statistics comprises at least one of: (i) any deviations by at least one racer from the assigned position within the formation, (ii) a reason for the deviation, and (ii) an impact of the deviation on the race performance of the group.

* * * * *